US012729528B2

(12) United States Patent
Le et al.

(10) Patent No.: US 12,729,528 B2
(45) Date of Patent: Sep. 8, 2026

(54) LEVER ASSEMBLY

(71) Applicant: Fluidmaster, Inc., San Juan Capistrano, CA (US)

(72) Inventors: Tuan Le, Fountain Valley, CA (US); Advait Bhatt, Chino, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 0 days.

(21) Appl. No.: 18/658,392

(22) Filed: May 8, 2024

(65) Prior Publication Data

US 2024/0368870 A1 Nov. 7, 2024

Related U.S. Application Data

(63) Continuation of application No. 16/675,271, filed on Nov. 6, 2019, now abandoned.

(60) Provisional application No. 62/756,505, filed on Nov. 6, 2018.

(51) Int. Cl.
*E03D 5/092* (2006.01)

(52) U.S. Cl.
CPC ..... *E03D 5/092* (2013.01)

(58) Field of Classification Search
CPC ..... E03D 5/09–094
See application file for complete search history.

(56) References Cited

U.S. PATENT DOCUMENTS 7,861,330 B2 * 1/2011 Tau ..... E03D 5/092 4/405
9,469,980 B2 10/2016 Le et al.
9,637,900 B2 5/2017 Yang
9,803,350 B2 10/2017 Guthrie et al.
9,932,729 B1 * 4/2018 Yeh ..... E03D 5/09
10,233,624 B1 3/2019 Huang
10,415,221 B2 9/2019 Mallela et al.
11,913,209 B2 * 2/2024 Tang ..... E03D 5/09
2005/0273919 A1 * 12/2005 Berlovan ..... E03D 5/092 4/405
2006/0225196 A1 * 10/2006 Yang ..... E03D 5/092 4/405
2007/0240256 A1 10/2007 Tau et al.
2007/0256223 A1 * 11/2007 Olshausen ..... E03D 5/092 4/405
2016/0376780 A1 12/2016 Yang
(Continued)

FOREIGN PATENT DOCUMENTS

WO 2017007540 A1 1/2017
WO WO2017007540 * 1/2017 ..... E03D 5/092

*Primary Examiner* — David P Angwin
*Assistant Examiner* — Nicholas A Ros
(74) *Attorney, Agent, or Firm* — Greenberg Traurig, LLP

(57) ABSTRACT

Methods and systems described herein are direct to an external lever configured to be positioned external to a toilet tank and actuated by a user to cause a toilet tank to flush. A first component comprising a first longitudinal member may couple to the external lever. A second component comprising a second longitudinal member may engage the first component at a perpendicular angle with respect to the first longitudinal member. The first and second components make up an arm that is configured to pass through a wall of the toilet tank. An internal lever arm may be positioned within the toilet tank such that the internal lever couples to the second component.

14 Claims, 41 Drawing Sheets

(56) References Cited

U.S. PATENT DOCUMENTS

2018/0202137 A1 7/2018 Mallela et al.
2024/0368870 A1* 11/2024 Le ..... E03D 5/092

* cited by examiner (Prior Art)

(Prior Art)

(Prior Art)

(Prior Art)

(Prior Art)

(Prior Art)

(Prior Art)

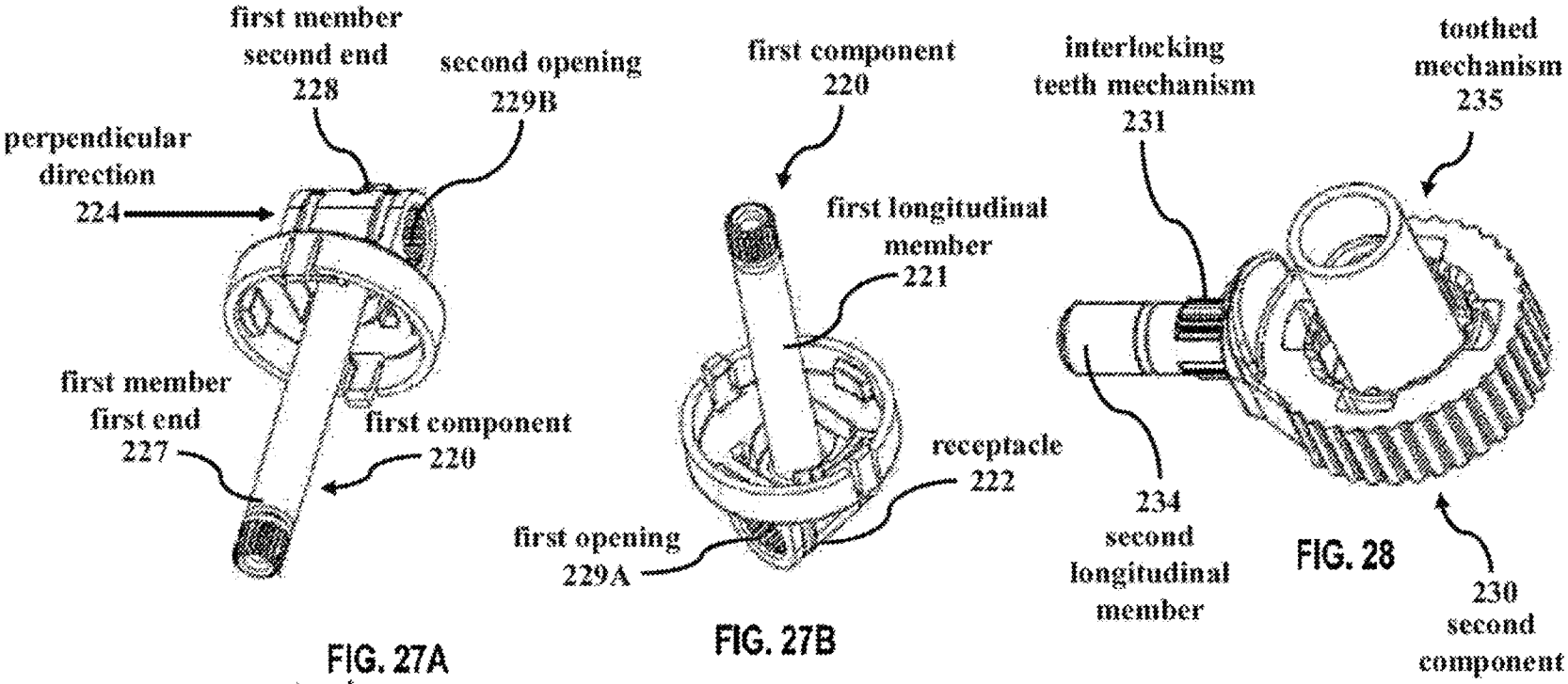
FIG. 28
FIG. 27B
FIG. 27A
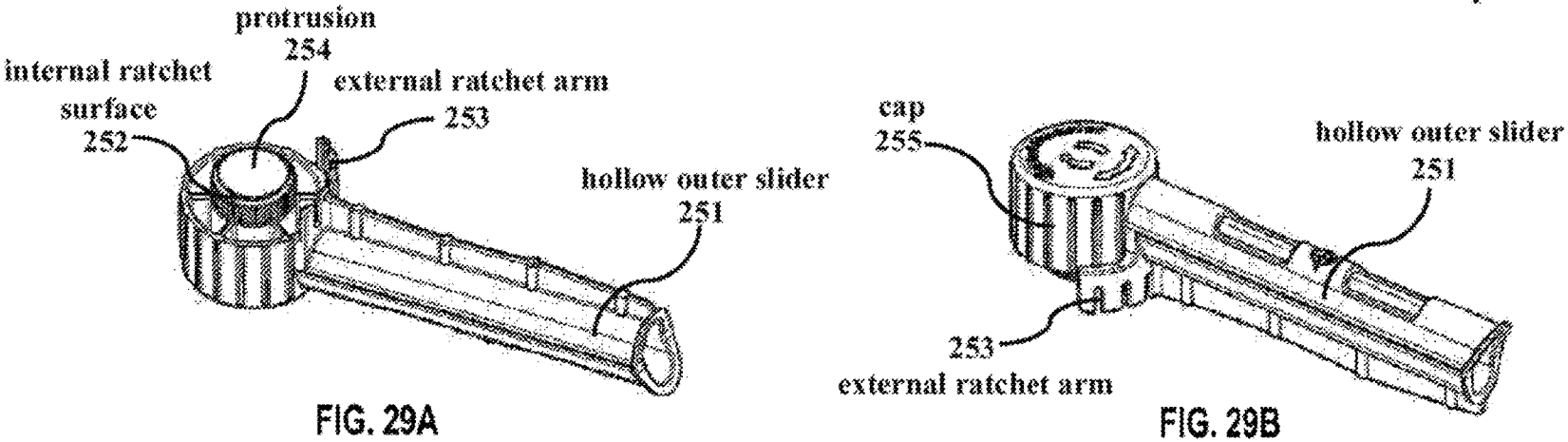
FIG. 29B
FIG. 29A

LEVER ASSEMBLY

CROSS-REFERENCE TO RELATED APPLICATIONS

This application is a Continuation Application of U.S. patent application Ser. No. 16/675,271, filed Nov. 6, 2019, which claims the benefit of and priority to U.S. Provisional Patent Application No. 62/756,505, filed Nov. 6, 2018, entitled, "LEVER ASSEMBLY", the entire contents of which are incorporated herein by reference.

BACKGROUND

Toilet flush lever assemblies typically include an external flush lever mounted on the outside of the toilet bowl which is acted upon by a user. The external flush lever is typically mechanically connected to an internal lever which moves within the toilet tank upon movement of the external flush lever. The internal lever arm is mechanically connected to a toilet flapper, often by a chain. A toilet flapper acts as a valve to the fluid outlet of a toilet tank, and seals the outlet when the flapper is not actuated by the flush lever arm. When a user pushes the external lever down (usually causing rotational movement about the axis through which it is mounted on the toilet tank) movement is transferred to an internal lever, which engages the chain and lifts the flapper, opening the fluid outlet and permitting the flow of water from the toilet tank into the toilet bowl.

Because the relative orientation between the toilet flush lever assembly and toilet flapper is not standard throughout the industry and among brands, replacement lever arms must either be purpose-built for specific toilet models, or else, they must be adjustable to work with multiple toilets having various differences in relative locations between the flush lever mount and the flapper. Also, because toilet flush levers are used frequently and in moist environments, the assemblies can degrade over time, necessitating early replacement.

Accordingly, there is a need for an easy to install toilet flush lever assembly that can be used with a wide variety of toilet models having toilet tanks of different shapes and sizes. Ideally, such an assembly would be easily retrofitted onto different toilet models, and capable of holding the end of the flapper chain (or similar device) directly over the flapper valve itself, enabling the chain to be pulled straight up to unseat the flapper valve.

Unfortunately, many current designs tend to use large, bulky components positioned within the toilet tank. As these components require space to rotate, they are difficult to position and do not fit all toilet geometries. What is instead desired is a toilet flush lever assembly that occupies a minimal amount of space within the toilet tank, and can be retrofitted into toilet tanks having flush handles on either side of the tank. Additionally, such a retrofit should be very easy for an end user to operate.

DESCRIPTION OF THE DRAWINGS

FIG. 27A shows a first view of a first component of the lever arm assembly according to some embodiments.

FIG. 27B shows a second view of a first component of the lever arm assembly according to some embodiments.

FIG. 28 shows a view of a second component of the lever arm assembly according to some embodiments.

FIG. 29A shows a first view of a hollow outer slider of the lever arm assembly according to some embodiments.

FIG. 29B shows a first view of the hollow outer slider of the lever arm assembly according to some embodiments.

DETAILED DESCRIPTION

Some embodiments described solve certain problems related to flush levers. The embodiments of the invention described herein can provide more degrees of freedom for adjustability than any known flush lever. Some embodiments provide the necessary offset and angle/stroke adjustability needed for side mounted toilet tanks, and can solve certain disadvantages of the assemblies of U.S. Pat. No. 9,469,980 and United States Patent Publication No. 2018/0202137 that are described below.

In some embodiments, the lever assembly disclosed herein can solve certain problems related to flush levers. In some embodiments, the lever assembly can provide more degree of freedom than any known flush lever to provide more adjustability for a user. In some embodiments, a first arm and second arm assembly can enable the lever to work in left, right, front, angle, side and other orientations in toilet tanks without losing leverage and stroke length. Some embodiments can function as a true universal lever.

In some embodiments, the left side toilet tank lever can be converted into the right side toilet tank lever in many ways, including, but not limited to, (i) without disassembling the first lever arm and the second arm with rotating the second arm and handle sub assembly, (ii) without disassembling second arm and handle sub assembly by detaching second arm from second arm and attaching second arm to the other side of second arm. This provides ease of installation to user.

Figure 1:
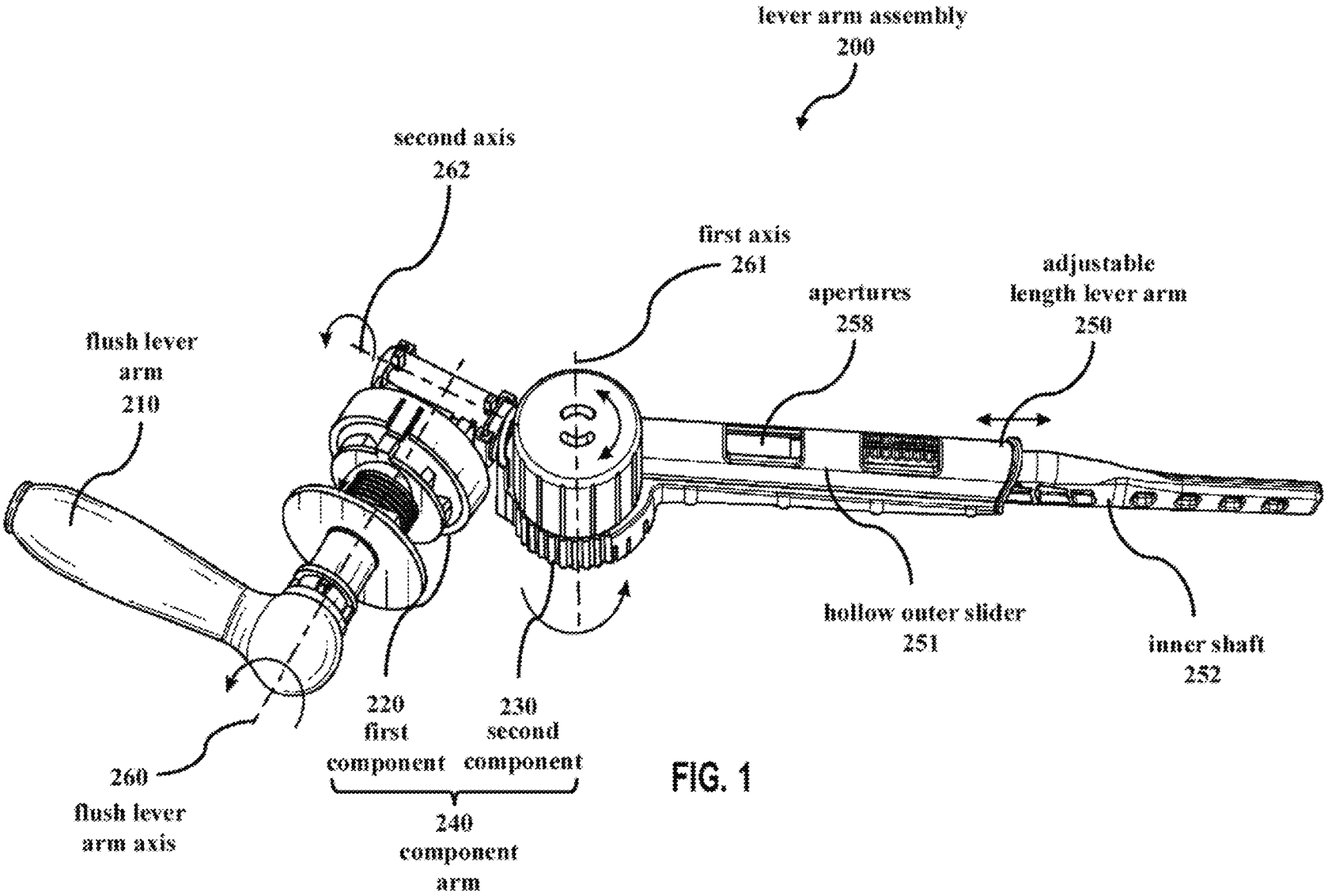
FIG. 1 is a perspective view of a lever arm assembly according to some embodiments.
Figure 2:
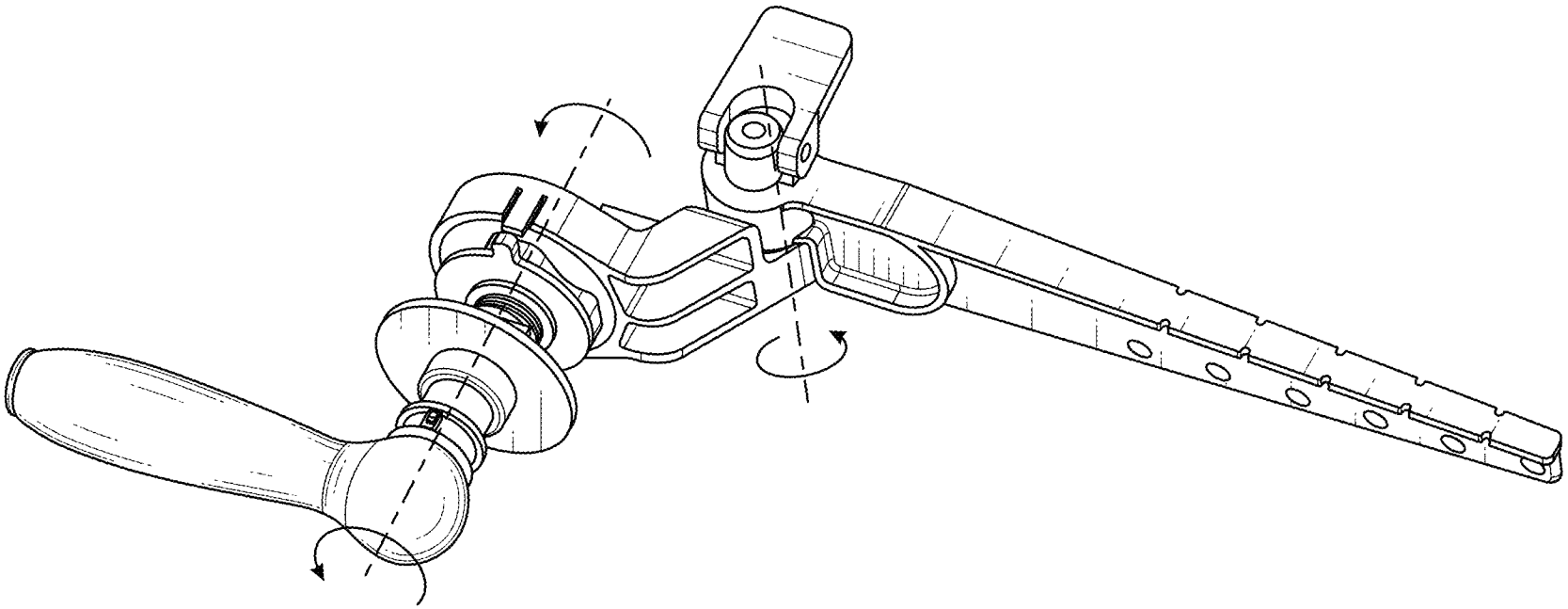
(Prior Art) FIG. 2
FIG. 2 is a perspective view of a lever according to some embodiments.
Figure 3A:
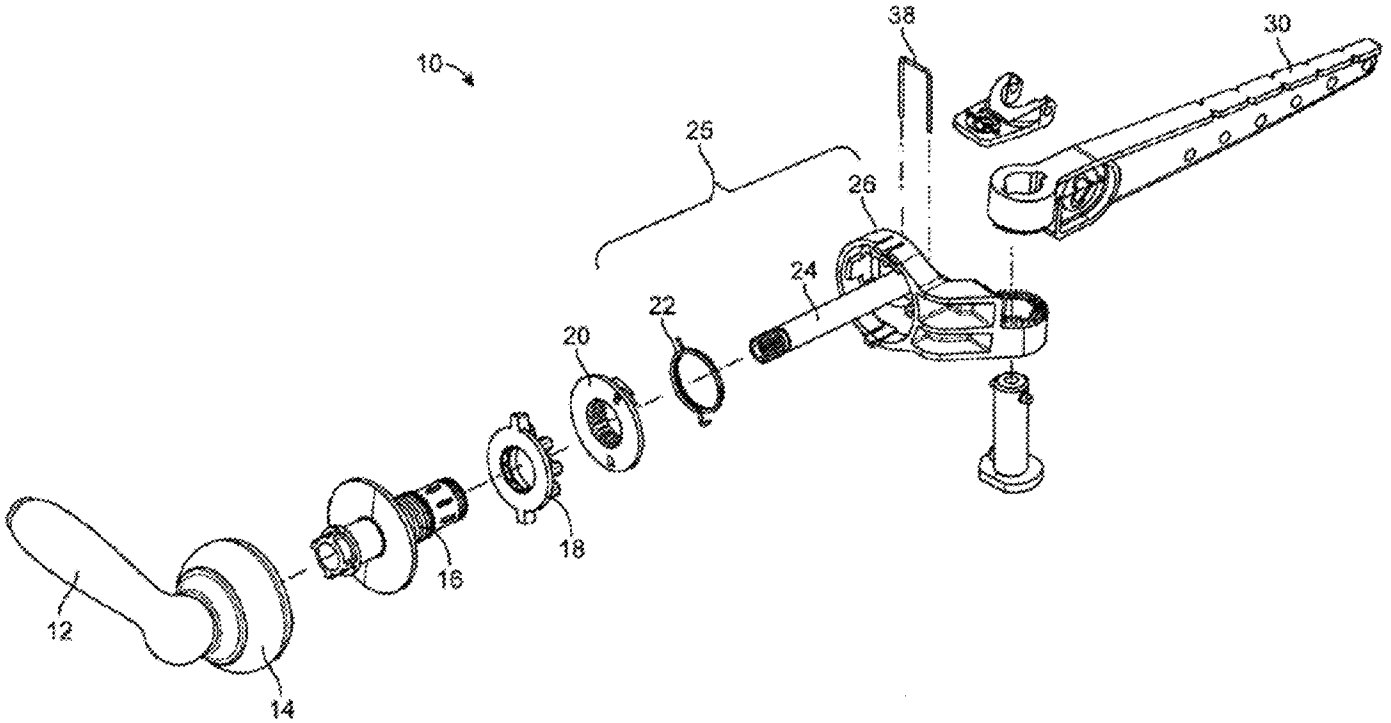
(Prior Art) FIG. 3A
FIG. 3A is an exploded perspective view of an assembly from one direction according to some embodiments.
Figure 3B:
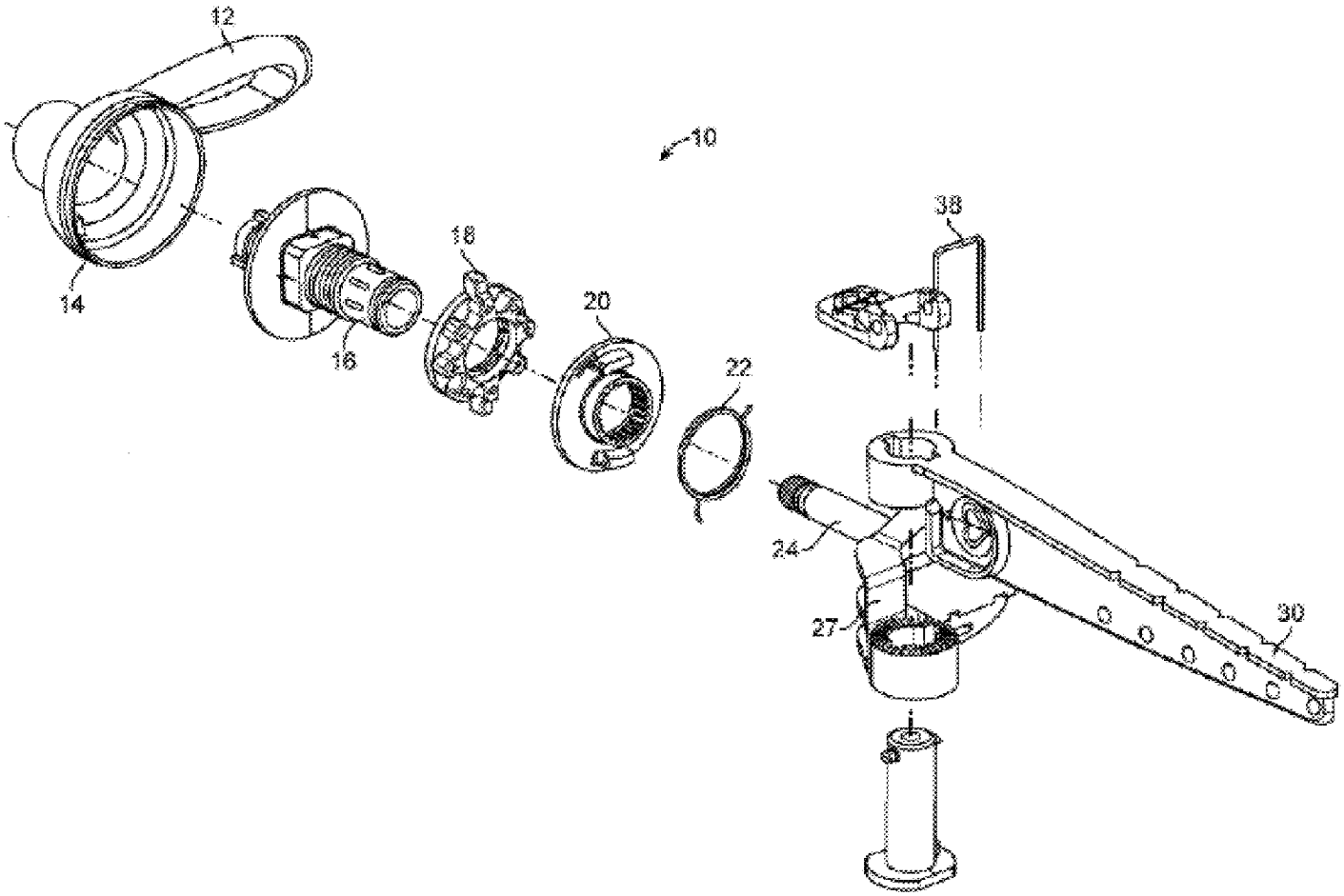
FIG. 3B is an exploded perspective view of an assembly, from an opposite direction according to some embodiments.
Figure 4:
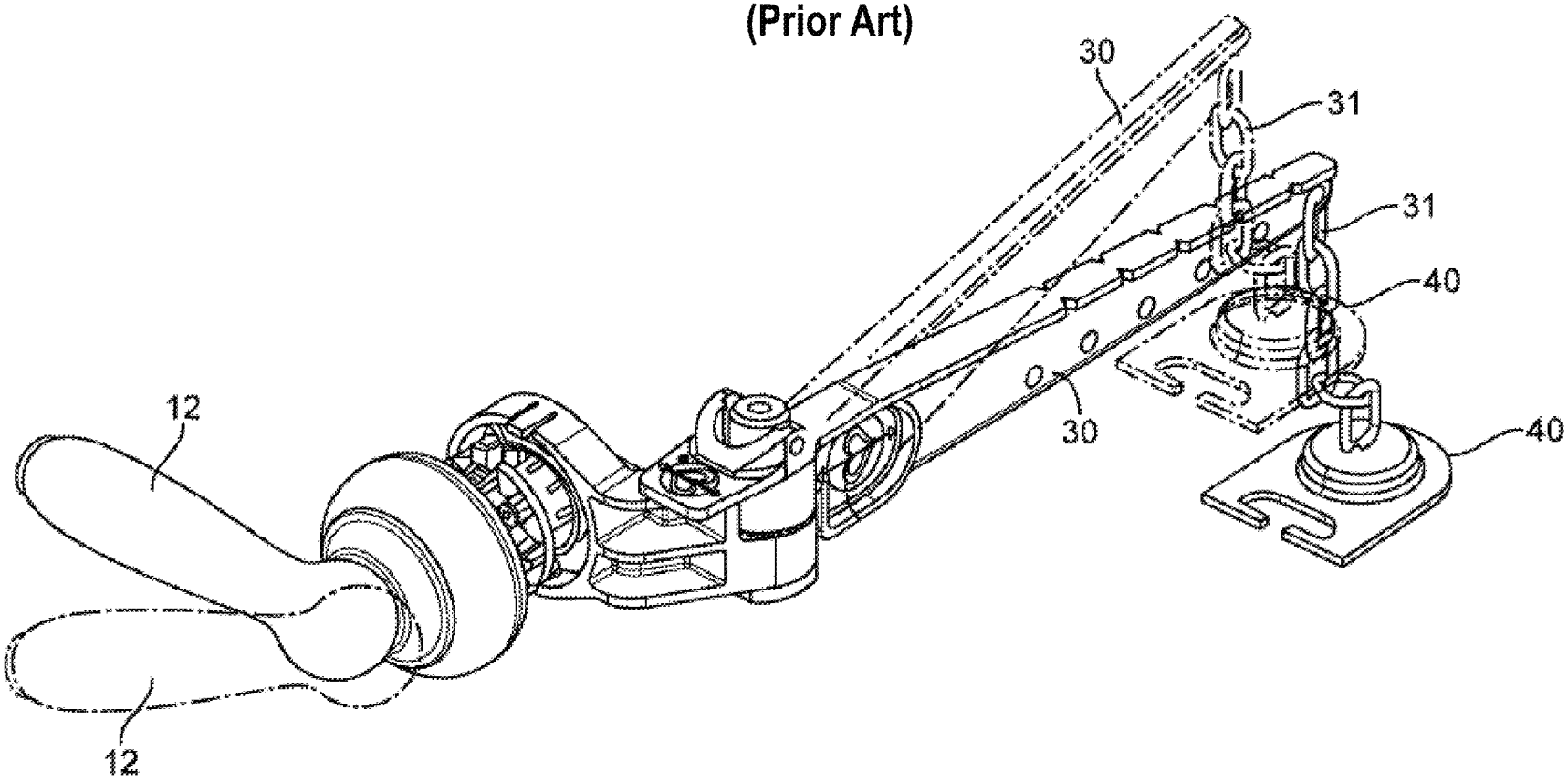
(Prior Art) FIG. 4
FIG. 4 is a perspective view of an assembly showing movement of the system components during operation according to some embodiments.

FIG. 1 is a perspective view of a lever assembly according to some embodiments. In some embodiments, one or more components of the assembly of FIG. 1 can comprise one or more components or assemblies of the lever assemblies of FIGS. 2-11 and/or the lever assemblies of FIGS. 13A-21D which are described in detail in support of the embodiment of FIG. 1. For example, in reference to FIGS. 2-11, FIG. 2 is a perspective view of a lever assembly disclosed in U.S. Pat. No. 9,469,980 describing a compact toilet flush lever assembly that can operate in a small space within the toilet tank. FIGS. 3A and 3B are exploded perspective views of the assembly taken from opposite directions. FIG. 4 is a perspective view showing movement of the present components during flushing operation. In some embodiments, assembly 10 can comprise a handle 12, a handle hub 14, a sleeve 16, a nut 18, a spring housing 20, a spring 22, a rotatable post 24, a lever mount 26, a second arm 27, and a lever 30. In some embodiments, lever housing 25 can include a rotatable portion (being lever mount 26) and a non-rotatable portion (being spring housing 20). In some embodiments, sleeve 16 can pass through the wall of the toilet tank. In some embodiments, components 12, 14 and 18 can be disposed outside of the toilet tank. In some embodiments, components 20 to 40 can be disposed within the toilet tank.

In some embodiments, handle 12 can rotate post 24 which in turn rotates lever mount 26. In some embodiments, lever mount 26 can rotate the axis of post 24. In some embodiments, the distal end of lever arm 30 can be moved up and down (such that a chain or cord 31 attached thereto can lift open a flapper valve 40 in the tank, causing the tank to flush. This is seen in FIG. 4 when a user pushes down on handle 12 (i.e. moving it to the dotted line position). In some embodiments, post 24 can be rotated such that it is lifted (i.e.: moving it to its own dotted line position). In some embodiments, sleeve 16 can remain stationary. In some embodiments, the movement of lever mount 26, second arm 27 and lever 30 together can act as the actuator portion of lever housing 25. In some embodiments, lever arm 30 can be rotatable such that it pivots around an end of second arm 27.

In some embodiments, spring 22 can be received into spring housing 20 (which also remains stationary). In some embodiments, as handle 12 is rotated, post 24 can rotate. In some embodiments, this can tighten spring 22. In some embodiments, spring 22 can resist the rotation of post 24. In some embodiments, when the operator releases handle 12 after a flush, spring 22 can simultaneously rotate handle 12 and lever mount 26 back into their pre-flush positions.

The benefit of using spring 22 or another biasing mechanism as an anti-rotation mechanism in some embodiments is that it can return lever arm 30 quickly back into its pre-flush position without having to rely on gravity. In some embodiments, there is no need to build a heavy counterweight into housing 30 to rotate lever 30 back down into its pre-flush position (e.g.: there is no need to add a weight to second arm 27). In some embodiments, this can reduce the size of the lever mount 26 (resulting in a smaller lever housing 25 with fewer or smaller components in the tank where space is at a premium).

Figure 5:
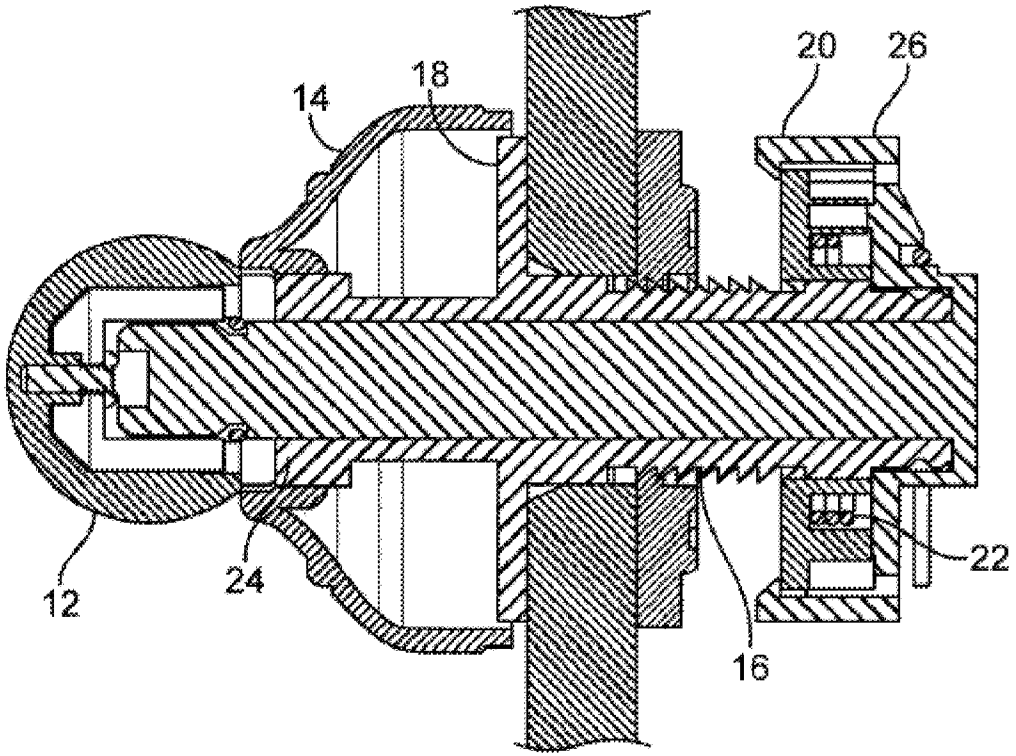
FIG. 5 is a sectional elevation view of a first assembly.

FIG. 5 illustrates details of a first assembly showing that nut 18 is positioned outside of the tank (and is covered by handle hub 14) according to some embodiments. In some embodiments, this can advantageously increase the amount of space within the tank, and therefore allows lever mount 26 to be mounted closer to the inside surface of the tank. In some embodiments, placing nut 18 within handle hub 14 can result in a system where nut 18 does not increase the overall length of the assembly.

Figure 6A:
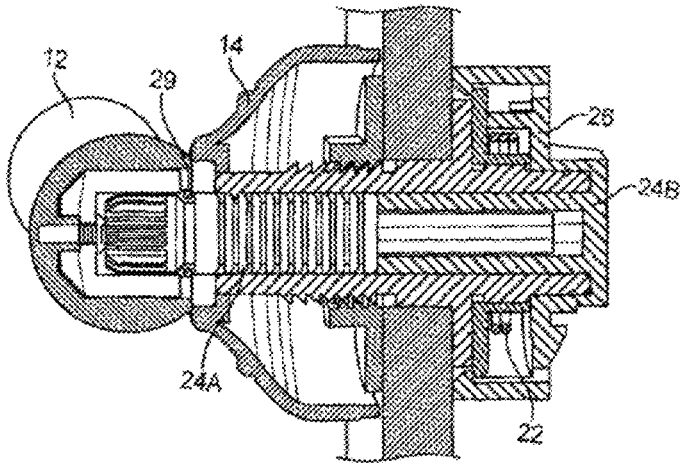
FIG. 6A (Prior Art)
FIG. 6A is a sectional elevation view of a second assembly installed on a narrow-walled toilet tank according to some embodiments.
Figure 6B:
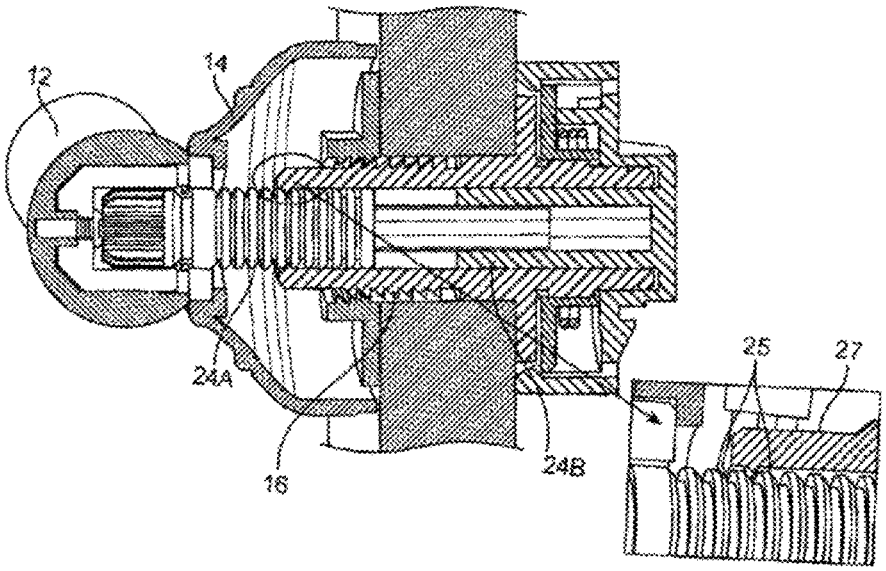
FIG. 6B is a sectional elevation view of a second assembly installed on a thick-walled toilet tank according to some embodiments.
Figure 7:
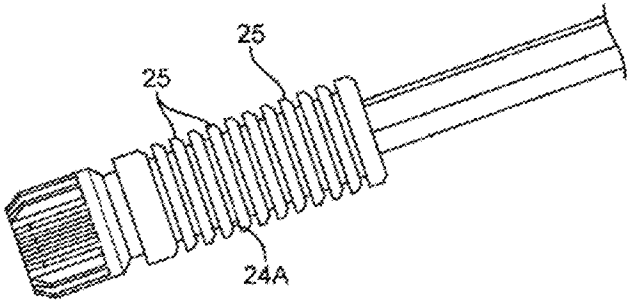
FIG. 7 (Prior Art)
FIG. 7 is a perspective view of the first post section of the second assembly of the rotatable post according to some embodiments.
Figure 8:
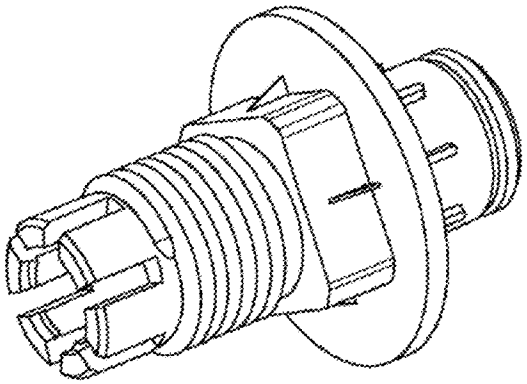
FIG. 8 is a perspective view of the sleeve, showing the notches for securing the first portion of the rotatable post according to some embodiments.

FIGS. 6A and 6B illustrate a second assembly that can be adjustable to different thicknesses of toilet walls according to some embodiments. In some embodiments, post 24 can be a two-part post, having an inner section 24A and an outer section 24B. In some embodiments, section 24A can slide within section 24B to vary the overall length of post 24. In some embodiments, this can advantageously accommodate both thin walled or thick-walled toilet tanks. In some embodiments, section 24A can have ribs 25 and the end of sleeve 16 can have a notch 27 such that when section 24A is pushed down into section 24B, it can slide into the position at which notch 27 snaps into its final position between two ribs 25, thereby holding sections 24A and 24B together within sleeve 16. FIG. 7 is a perspective view of the inner post section 24A of the second assembly of rotatable post 24 according to some embodiments. FIG. 8 is a perspective view of sleeve 16, showing notches 27 for securing the first portion 24A of the rotatable post and the second portion 24B of the rotatable post together according to some embodiments.

Figure 9A:
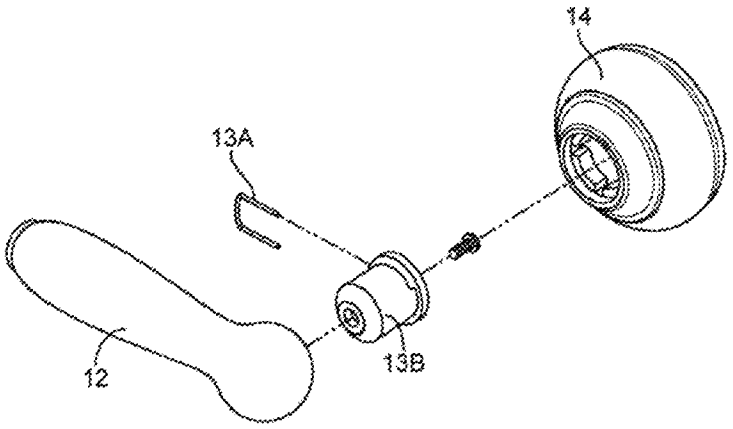
FIG. 9A (Prior Art)
FIG. 9A is an exploded perspective view of the coupling mechanism in the flush handle that adjustably couples to the end of the rotatable post according to some embodiments.
Figure 9B:
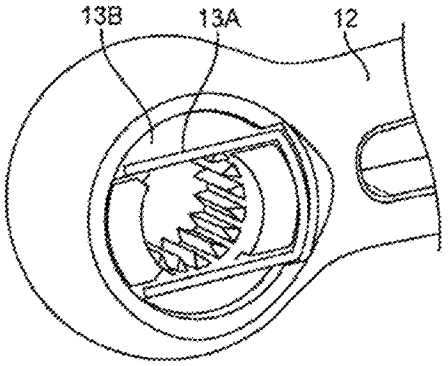
FIG. 9B (Prior Art)
FIG. 9B in another exploded perspective view of the coupling mechanism in the flush handle from an opposite direction according to some embodiments.

FIGS. 9A and 9B illustrate details of how the toilet flush handle 12 can be mounted to the end of rotatable post 24 that is positioned outside of the toilet tank according to some embodiments. In some embodiments, toilet flush handle 12 can include an expandable clip 13A that is received into an insert 13B which is in turn received into the flush handle 12. In some embodiments, clip 13A can be deformed outwardly to pass over the end of rotatable post 24 and is then received ("snapped") into a groove 29 on the rotatable post. In some embodiments, toilet flush handle 12 can be coupled onto rotatable post 24. In some embodiments, toilet flush handle 12 can produce an audible clicking sound when it is click-fit onto the end of rotatable post 24.

Figure 10A:
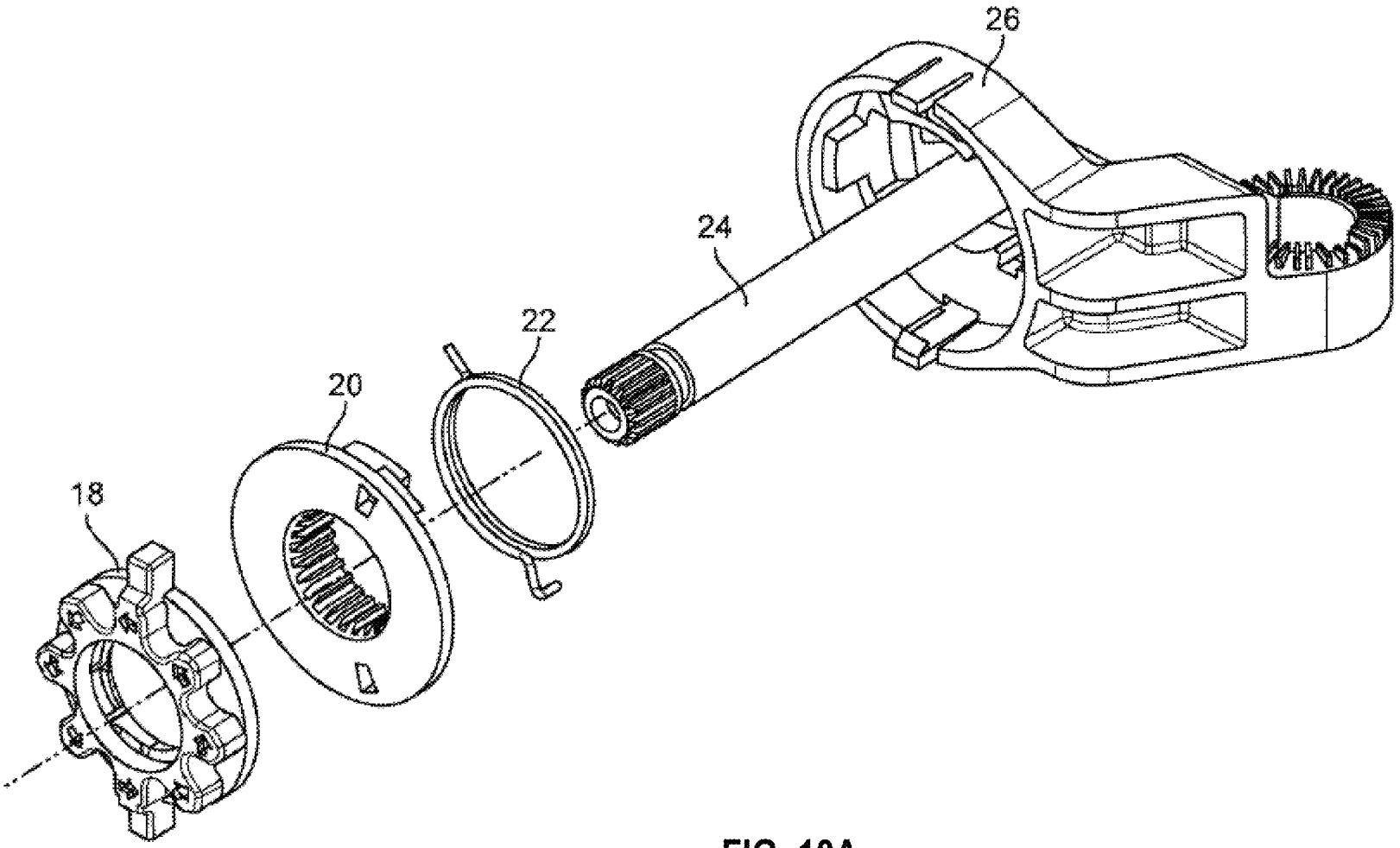
FIG. 10A is an exploded perspective view of the components of the lever housing according to some embodiments.
Figure 10B:
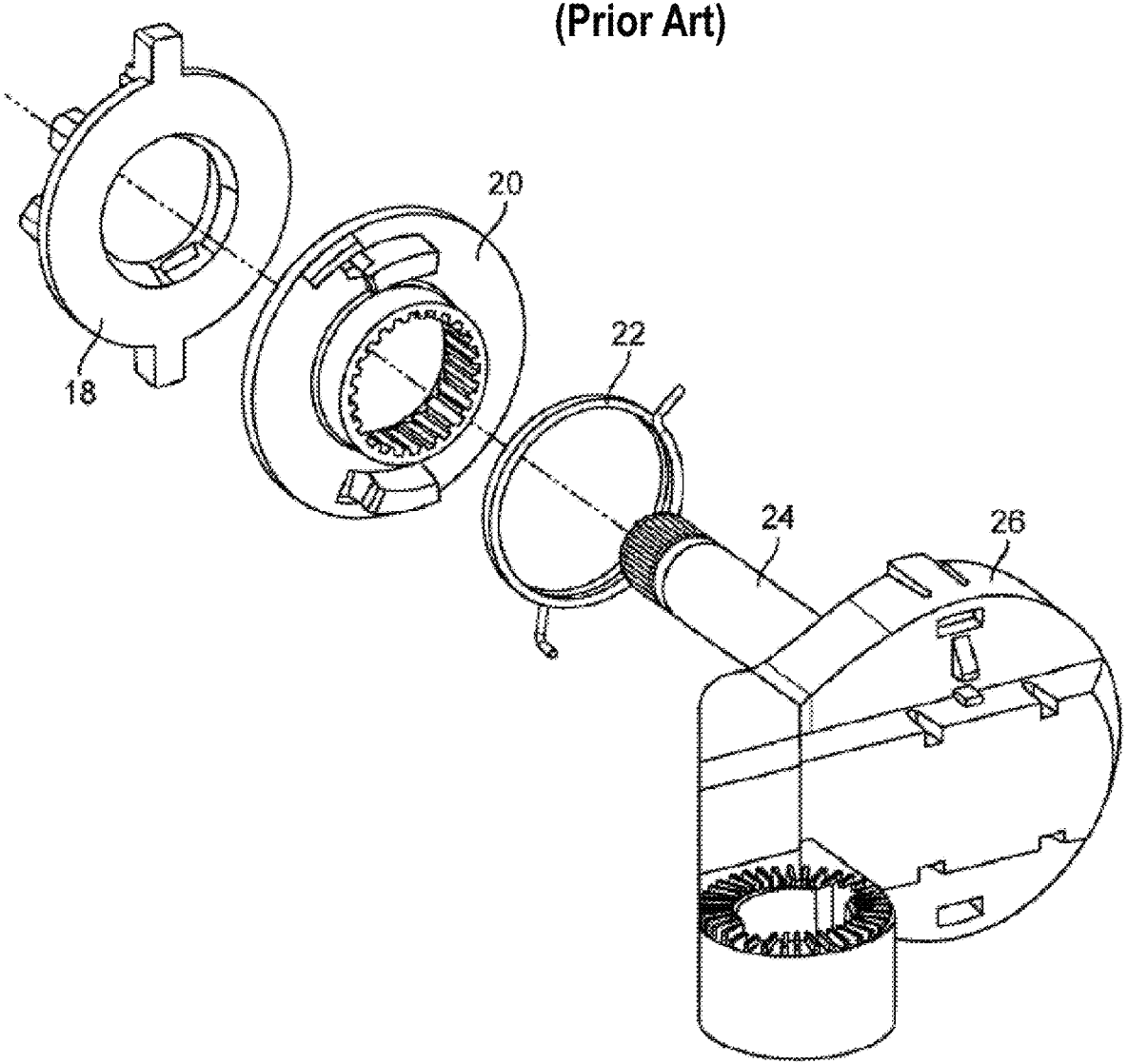
FIG. 10B is another exploded perspective view of the components of the lever housing from an opposite direction according to some embodiments.

FIGS. 10A and 10B illustrate details of the workings of the components in lever housing 25 according to some embodiments. In some embodiments, lever housing 25 can comprise a non-rotatable portion (spring mount 20) and a rotatable portion lever mount 26. In some embodiments, the rotatable portion (spring mount 26) can rotate together with rotatable post 24 and handle 12. In some embodiments, the non-rotatable portions (spring mount 20 and nut 18) can be positioned against the inside and outside wall surfaces of the toilet tank. In some embodiments, spring 22 can be positioned in spring housing 20 with one end against an internal surface of spring housing 20, and an opposite end against lever mount 26. (Spring housing 20 can be received into lever mount 26.

In some embodiments, spring 22 can move the rotatable portion of the housing with respect to the non-rotatable portion of the housing to rotate the post back to the neutral position. In some embodiments, spring 22 can rotate post 24 back to the neutral position from either direction. In some embodiments, the assemblies can be used on either a left or right-handed toilet (i.e.: a toilet with the flush handle on either the left or right side of the tank). In some embodiments, the rotatable portion 26 of lever housing 25 can be mounted to the end of post 24 by a clip 38 that is received into a groove on the rotatable post.

Figure 11:
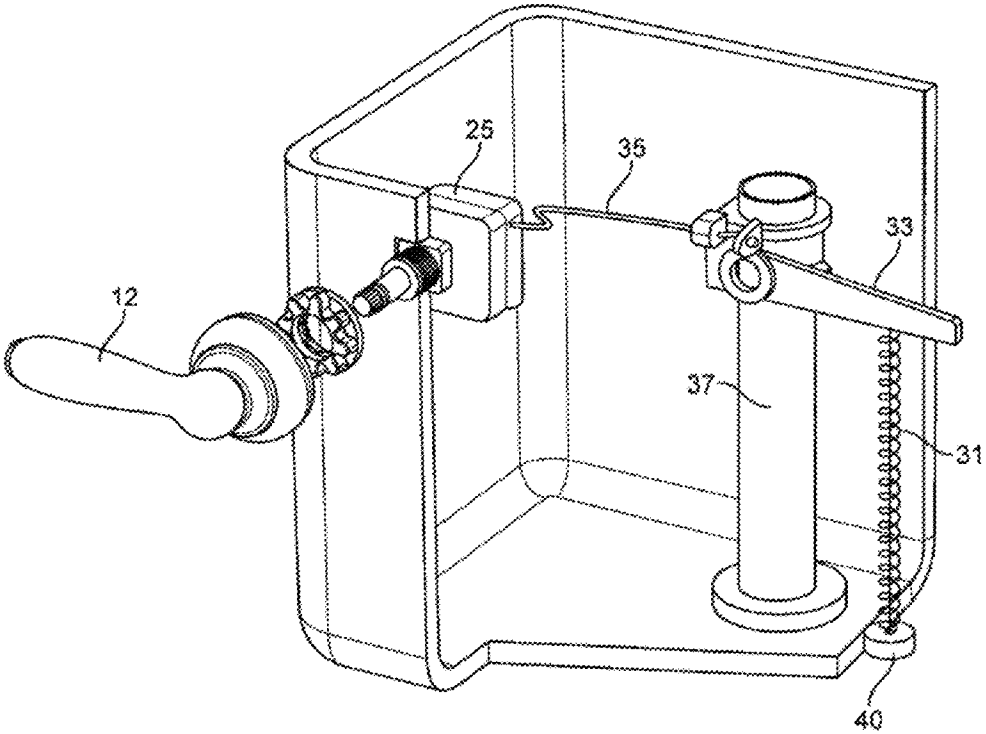
FIG. 11 is a perspective view of a third lever assembly according to some embodiments.

FIG. 11 is a perspective view of another assembly in which lever housing 25 instead comprises a cable 35 extending a lever arm 33 mounted on an overflow tube 37 according to some embodiments. In some embodiments, cable 35 can lift lever arm 33 when handle 12 is pushed down. In some embodiments, chain 31 can lift flapper 40, initiating a flush.

In some embodiments, FIGS. 13A-21D can include one or more assemblies of an embodiment of FIG. 1. In some embodiments, this assembly can provide a toilet flush lever arm assembly, comprising: (a) an external flush lever arm; (b) a second arm passing through the wall of the toilet tank and connected to the external flush lever arm; and (c) an adjustable length internal lever arm also connected to the second arm. In some embodiments, the second arm can hold the adjustable length internal lever arm at an angle that is adjustable. In some embodiments, toilet flush lever arm assembly 10 can comprise an external flush lever arm 20; a second arm 30 connected to external flush lever arm 20; and an adjustable length internal lever arm 40 connected to second arm 30.

In some embodiments, the adjustable length internal lever arm can comprise: (i) an inner shaft, (ii) a hollow outer slider received onto the inner shaft, and (iii) a locking mechanism to fix the inner shaft at a desired position along the length of the hollow outer slider. In some embodiments, the locking mechanism can comprise a projection on the inner shaft that protrudes through one of several apertures on the hollow outer slider.

In some embodiments, the hollow outer slider can remain in a fixed position with the inner shaft being moveable in a distal or proximal direction within the hollow outer slider. In some embodiments, the chain of a flush valve can be connected to the inner shaft. In some embodiments, the inner shaft can remain in a fixed position with the hollow outer slider being moveable in the distal or proximal direction. In some embodiments, the chain of a flush valve can be connected to the hollow outer slider.

In some embodiments, the locking mechanism in the adjustable length internal lever arm can comprise deflectable snaps on the hollow outer slider that can rotate to lock into apertures in the inner shaft. In some embodiments, the locking mechanism can be a protrusion on the interior of the hollow outer slider.

In some embodiments, different interlocking teeth can be presented for connecting the second arm to the adjustable length internal lever arm such that the angle of connection can be varied by an operator as desired. In some embodiments, any conventional locking mechanism can be used including, without limitation, frictional engagement, interlocking members, detents and the like.

In some embodiments, advantages can include the adjustability of the length of the internal lever arm (which lifts the chain to unseat the flapper valve), and of the angle at which the internal lever arm can be mounted within the tank. In some embodiments, the internal lever arm can easily be positionable within a wide variety of sizes and shapes of toilet tanks (including front-mount, side-mount, angle-mount and even right-hand-flush toilet lever configurations). In some embodiments, the axially adjustable internal lever arm can include a radially adjustable interlock with the second arm. In some embodiments, it can provide an advantage of positioning the distal end of the internal lever arm directly (or near directly) over the flapper, thus creating a better connection and superior flush lever mechanism. In some embodiments, the axially adjustable internal lever arm can comprise as few as two pieces. Some embodiments comprise an advantage of lower production costs, easier assembly, and increased reliability.

Figure 13A:
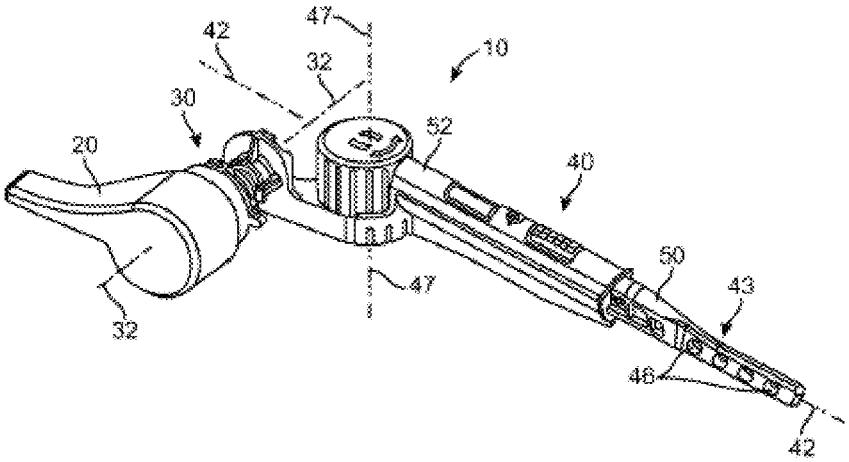
FIG. 13A is a perspective view of a first assembly of a lever arm assembly according to some embodiments.
Figure 13B:
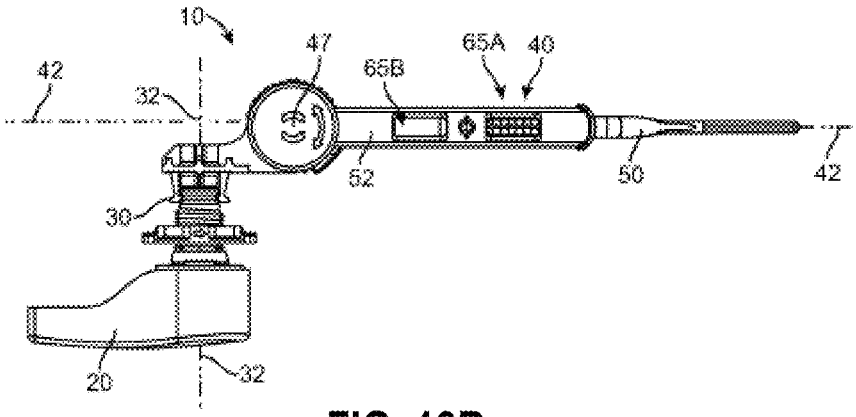
FIG. 13B is a top plan view corresponding to FIG. 13A according to some embodiments.
Figure 13C:
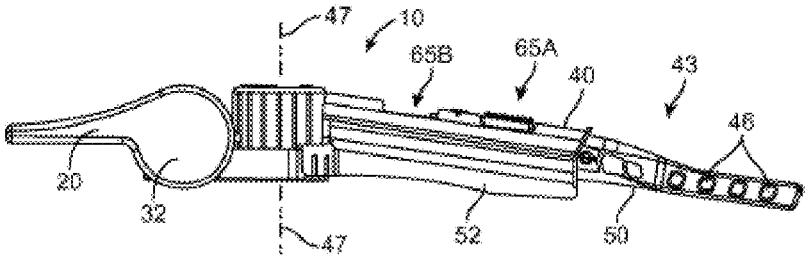
FIG. 13C is a side elevation view corresponding to FIG. 13A according to some embodiments.

In some embodiments, second arm 30 can pass through a wall of a toilet tank (not shown) and external flush lever arm 20 can rotate around a longitudinal axis 32 passing centrally through second arm 30. In some embodiments, second arm 30 can hold adjustable length internal lever arm 40 at an adjustable angle. In some embodiments, the adjustable angle can be 90 degrees (i.e., the angle between axes 32 and 42), as shown in FIG. 13B. In some embodiments, arm 40 can be rotatable about axis 47. In some embodiments, distal end 43 of the adjustable length internal lever arm 40 can comprise a plurality of apertures 46 for connecting to the chain (not shown) of a toilet flapper assembly.

Figure 13D:
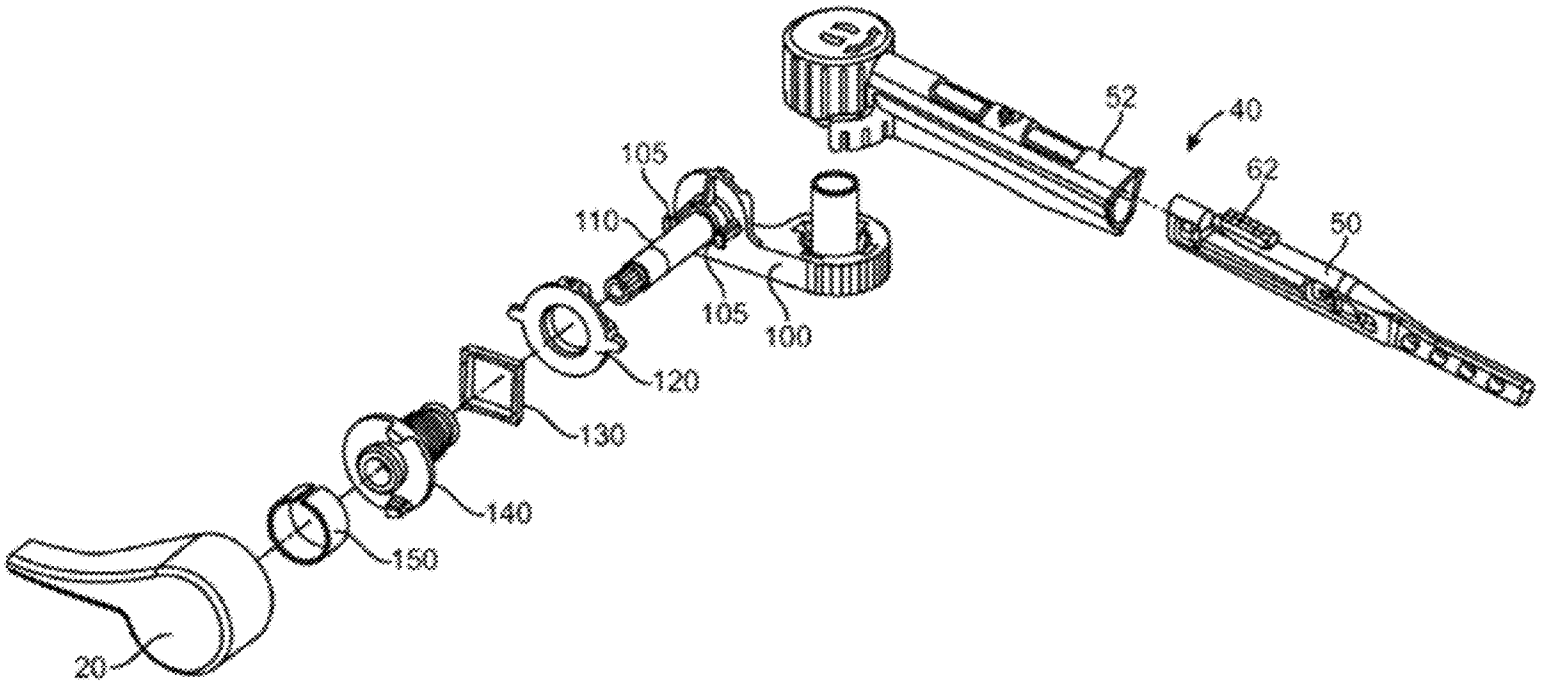
FIG. 13D is an exploded perspective view corresponding to FIG. 13A according to some embodiments.
Figure 14A:
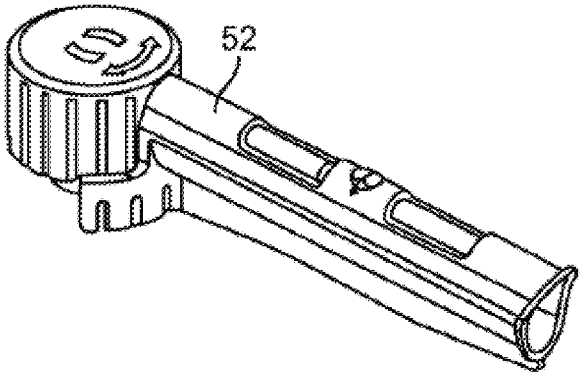
FIG. 14A is perspective view of the outer slider of the adjustable length arm seen in FIG. 13A according to some embodiments.
Figure 14B:
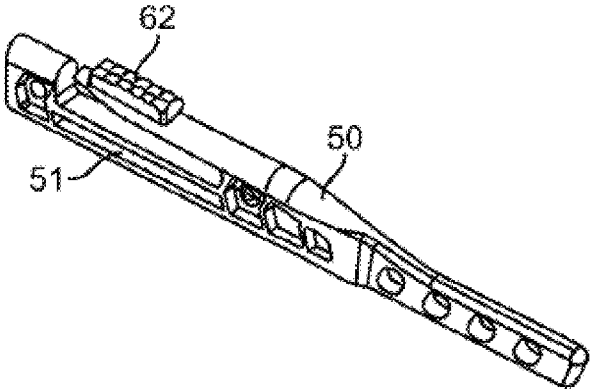
FIG. 14B is a perspective view of the inner shaft of the adjustable length arm seen in FIG. 13A according to some embodiments.

In some embodiments, the adjustable length internal lever arm 40 can comprise: an inner shaft 50, and a hollow outer slider 52 received onto inner shaft 50, as shown in FIGS. 13D, 14A and 14B. In some embodiments, the length of arm 40 can be adjusted by moving inner shaft 50 back and forth within outer slider 52.

Figure 13E:
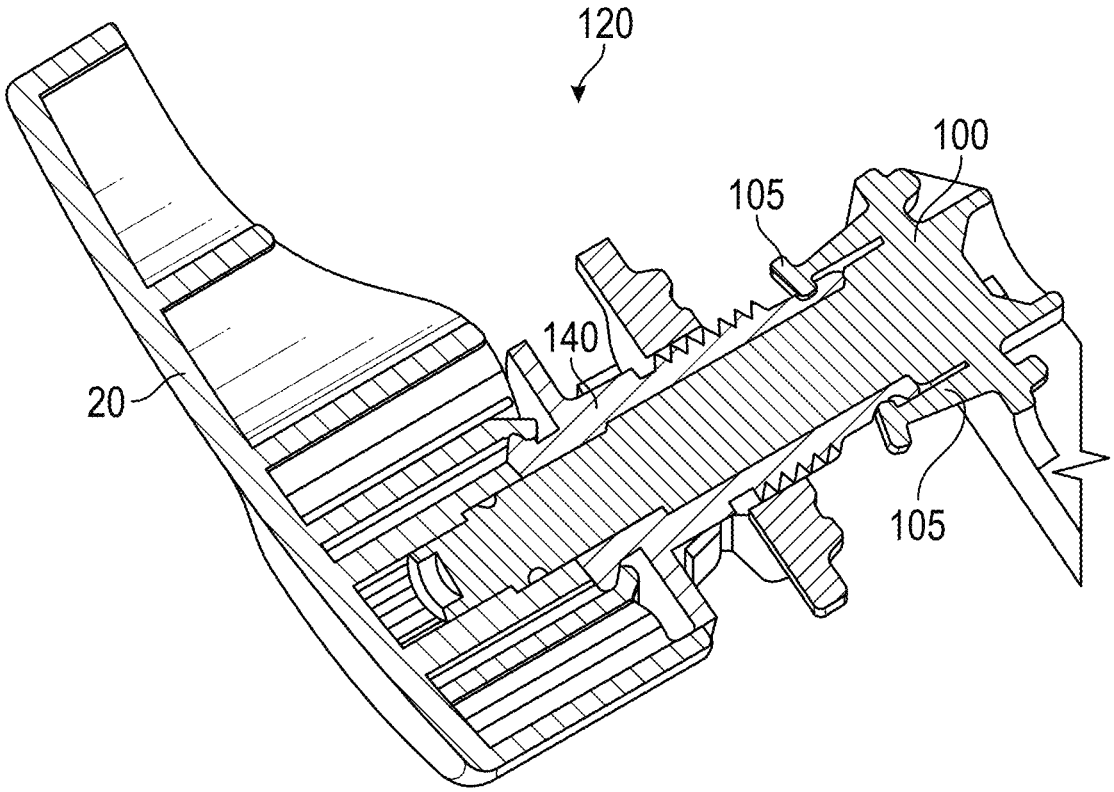
FIG. 13E is a sectional view of the interlocking of the handle, second arm and first arm seen in FIG. 13A according to some embodiments.

In some embodiments, second arm 30 can include one or more of distal mount 100 having locking arms 105, and a tubular projection 110, as shown in FIG. 13D. In some embodiments, optional nut 120, washer 130, chassis 140 and clip 150 can also be included. In some embodiments, the components of second arm 30 can be snap-fit together with the distal end of chassis 140 held by locking arms 105, and the proximal end of tubular projection 110 being received within handle 20, as shown in FIG. 13E.

In some embodiments, the adjustable length internal lever arm 40 can comprise: an inner shaft 50, a hollow outer slider 52 received onto inner shaft 50, and a locking mechanism to fix the inner shaft 50 at a desired position along within the length of outer slider 52, as shown in FIGS. 13A through 15B. In some embodiments, inner shaft 50 can have a projection 62 thereon. In some embodiments, inner shaft 50 can have a hollow mid-section 51 (FIG. 14B) adjacent to the projection thereon to permit projection 62 to flex inwardly when depressed.

Figure 15A:
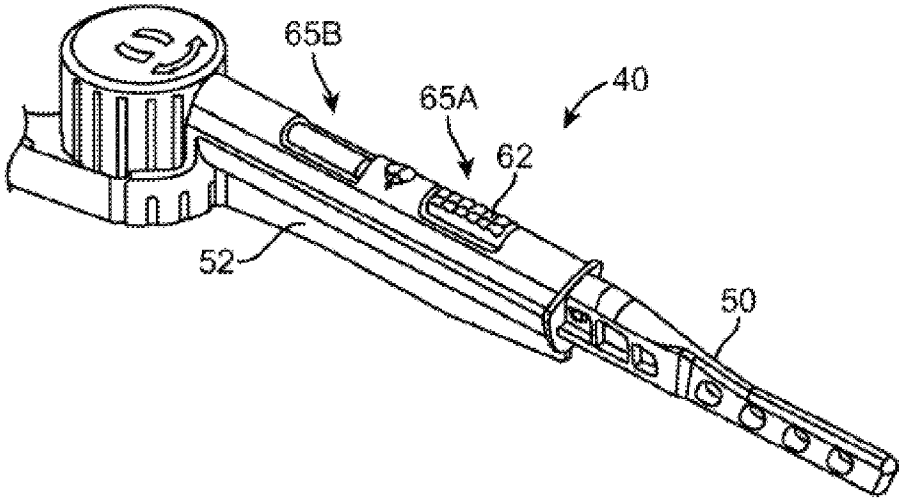
FIG. 15A is a perspective view of the adjustable length internal lever arm of FIG. 13A with the internal lever arm at maximum length according to some embodiments.
Figure 15B:
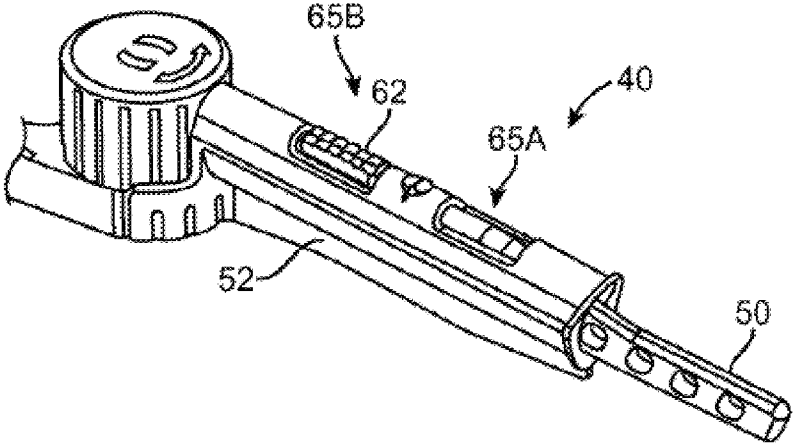
FIG. 15B is a perspective view of the adjustable length internal lever arm of FIG. 12A with the internal lever arm at minimum length according to some embodiments.

In some embodiments, projection 62 on inner shaft 50 can protrude through one of apertures 65 to fix the hollow outer slider at a desired position along the length of inner shaft 50, as shown in FIGS. 15A and 15B. In some embodiments, projection 62 can be positioned to project out of aperture 65A (FIG. 15A), then internal lever arm 40 can be extended to its maximum length. In some embodiments, when projection 62 is positioned to project out of aperture 65B (FIG. 15B), internal lever arm 40 can be reduced to its minimum length. In some embodiments, having more than two apertures 65, intermediate length settings can be provided.

Figure 16A:
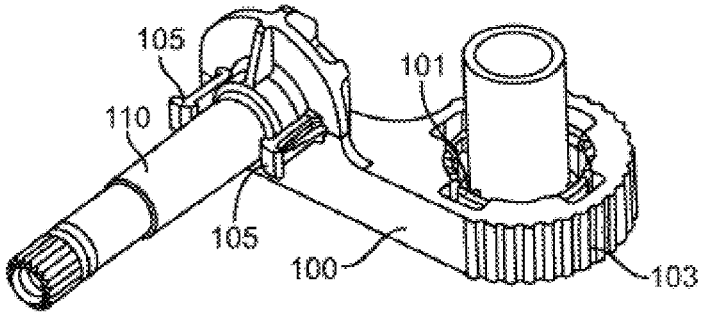
FIG. 16A is a perspective view of the locking mechanism at the distal end of the second arm seen in FIG. 13A according to some embodiments.
Figure 16B:
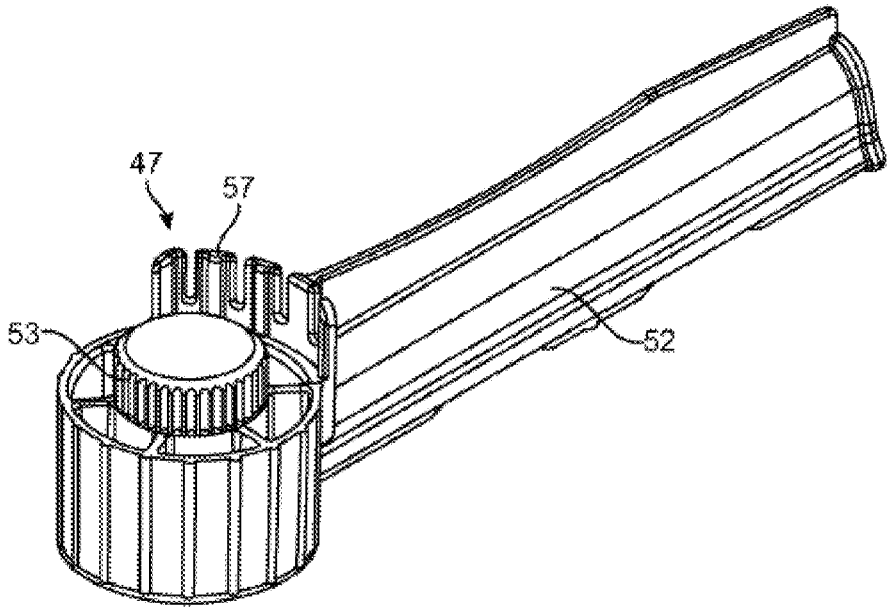
FIG. 16B is a perspective view of the locking mechanism at the proximal end of the internal lever arm seen in FIG. 13A according to some embodiments.

FIGS. 16A and 16B illustrate an interlocking mechanism between distal mount 100 of second arm 30 (FIG. 16A) and proximal end 41 of outer slider 52 according to some embodiments. In some embodiments, distal mount 100 can have an internal ratchet 101 and an external ratchet surface 103. In some embodiments, outer slider 52 can have an internal ratchet surface 53 and external ratchet arms 57. In some embodiments, elements 103 and 57 can mate together and elements 101 and 53 can mate together (when surface 103 is received within arm 57 and surface 53 is received within ratchet elements 101).

Figure 17A:
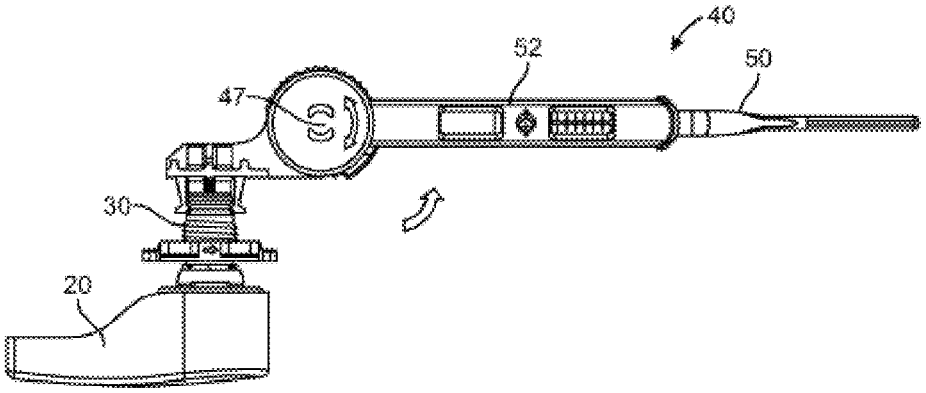
FIG. 17A is a top plan view of the assembly used with a left-handed toilet handle according to some embodiments.
Figure 17B:
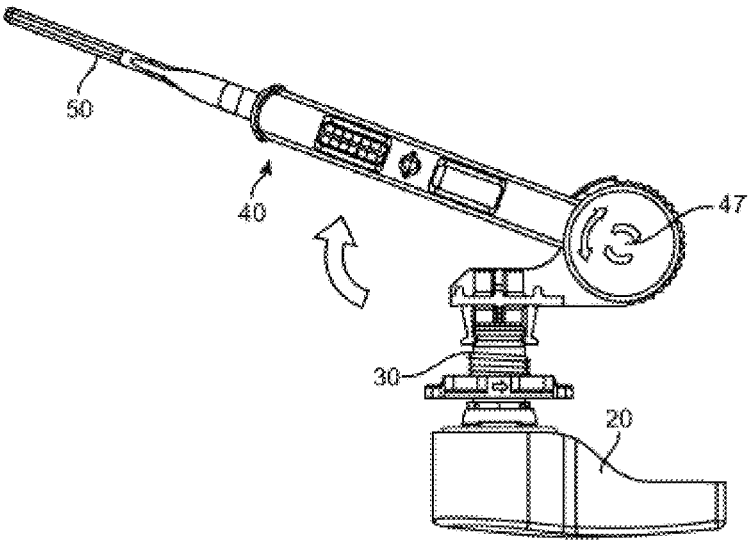
FIG. 17B is a top plan view of the assembly used with a right-handed toilet handle according to some embodiments.

FIG. 17A illustrates an installation on a left-handed toilet according to some embodiments. In some embodiments, the installer can rotate variable length first arm 40 in a counterclockwise direction about axis 47 to reach a desired position with inner shaft 50 over the flapper valve (not illustrated). FIG. 17B illustrates a right-handed toilet according to some embodiments. In some embodiments, the installer can rotate variable length first arm 40 in a clockwise direction about axis 47 to reach a desired position with inner shaft 50 over the flapper valve (not illustrated).

Figure 18A:
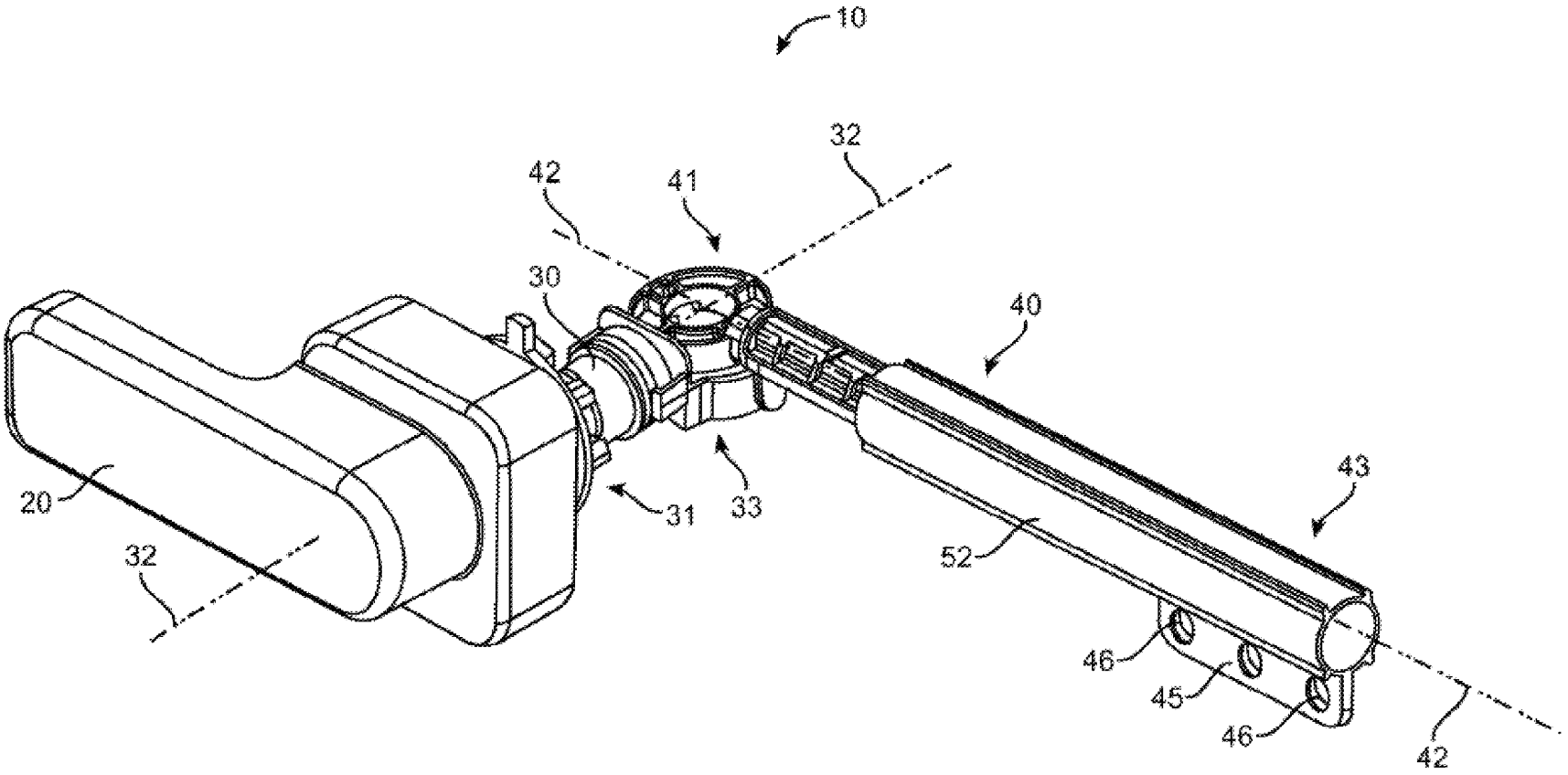
FIG. 18A is a perspective view of a second assembly of the present lever arm assembly according to some embodiments.
Figure 18B:
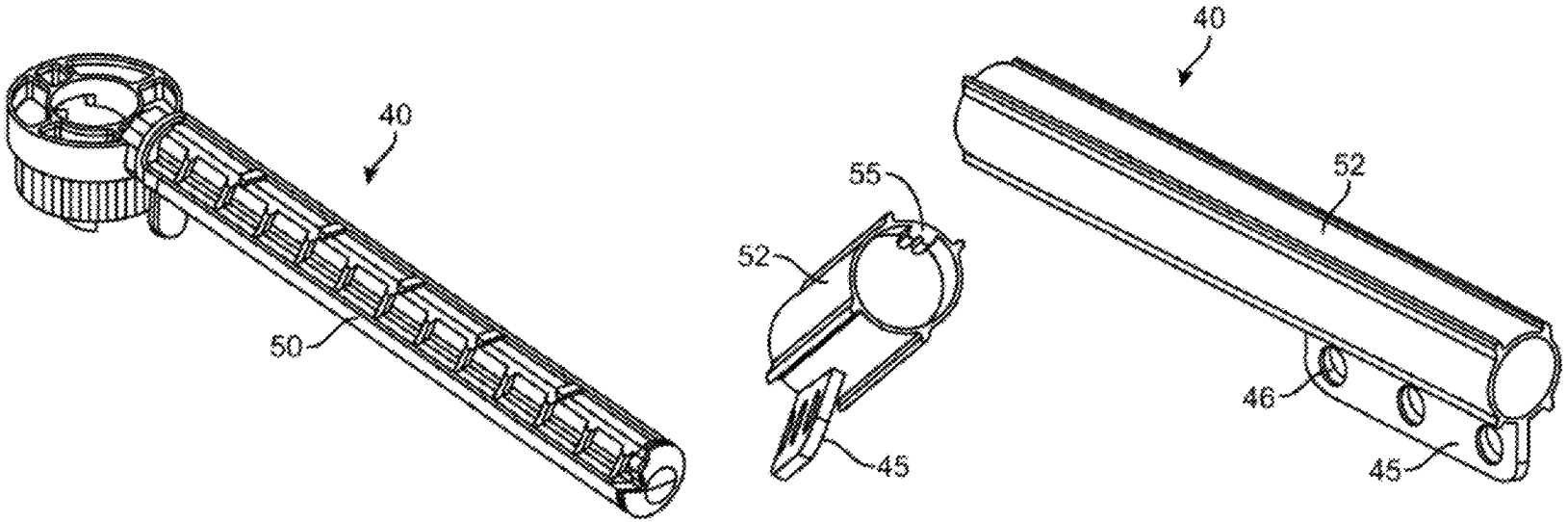
FIG. 18B is an exploded perspective view of the internal lever arm seen in FIG. 18A according to some embodiments.
Figure 18C:
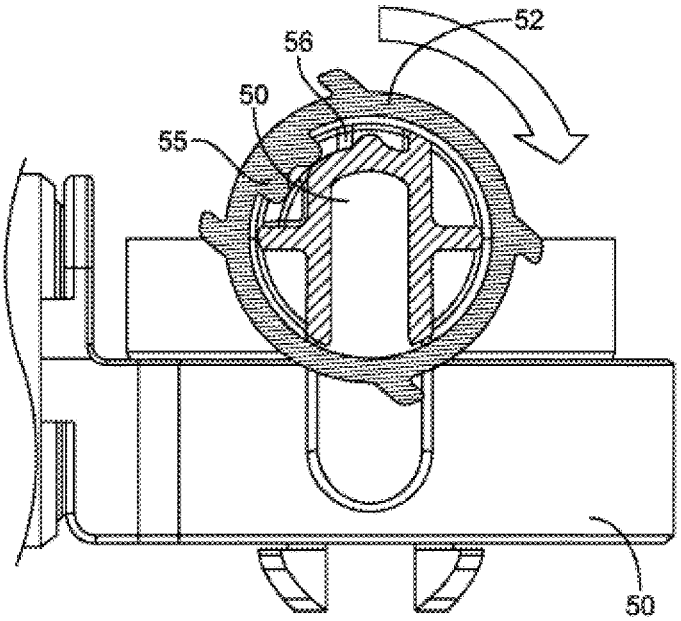
FIG. 18C is a sectional elevation view of the locking mechanism of FIGS. 18A and 18B in an unlocked position according to some embodiments.
Figure 18D:
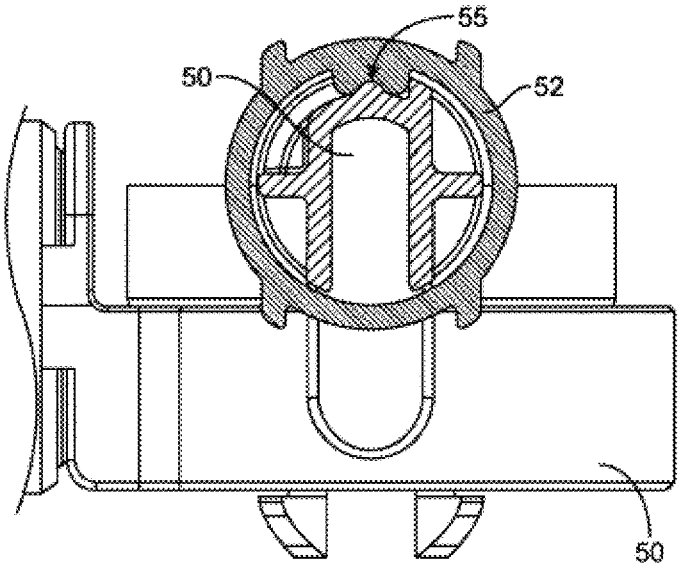
FIG. 18D is a sectional elevation view of the locking mechanism of FIGS. 18A and 18B in a locked position according to some embodiments.

FIGS. 18A to 18D illustrate an alternative assembly of the adjustable length internal lever arm 40 according to some embodiments. Some embodiments comprise a moveable hollow slider 52 with a projection 54 thereon. (Note: FIG. 18B displays two outer sliders 52 rotated such that both ends of the slider 52 can be seen). In some embodiments, slider 52 can have a flange 45 extending therefrom with apertures 46 therein. In some embodiments, the locking mechanism can comprise deflectable snaps 55 on the hollow outer slider 52 that can rotate to lock into apertures 56 in inner shaft 50, as shown in FIGS. 6C and 6D.

Figure 19A:
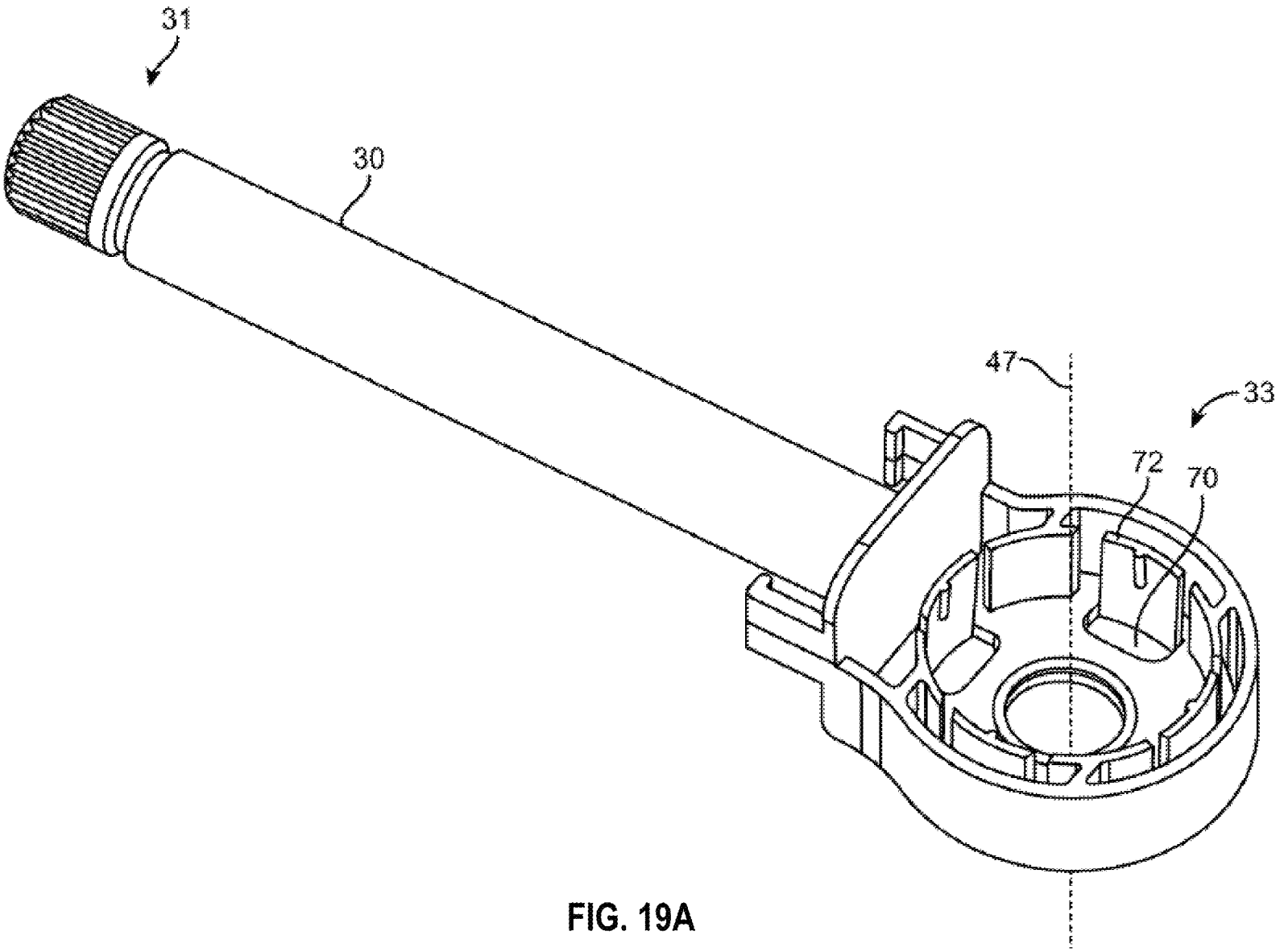
FIG. 19A is a perspective view of another assembly of the locking mechanism of the second arm according to some embodiments.
Figure 19B:
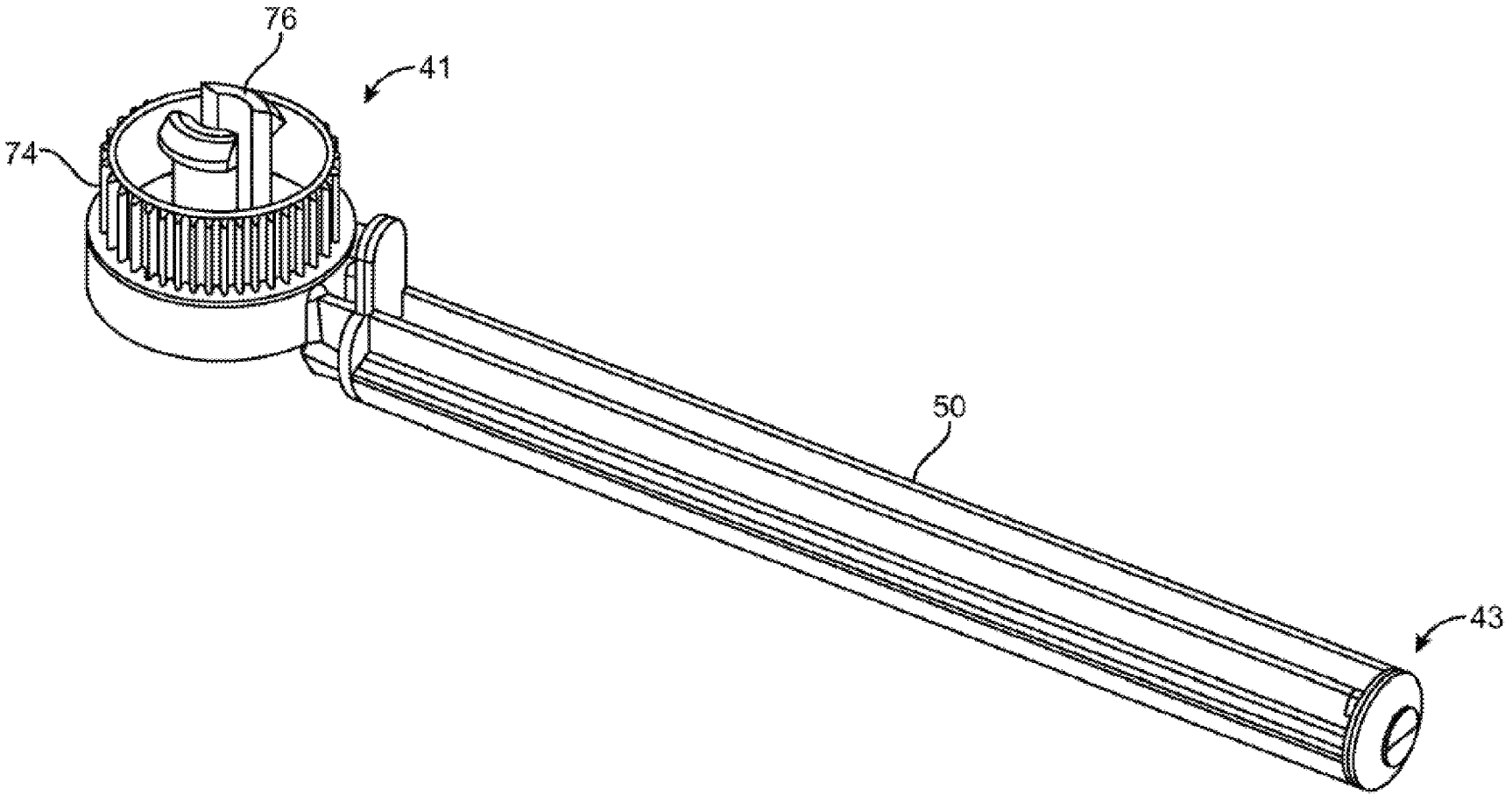
FIG. 19B is a perspective view of an assembly of the internal arm for use with the locking mechanism of the second arm of FIG. 19A according to some embodiments.

FIGS. 19A and 19B illustrate an alternative assembly of the locking mechanism for securing the position of internal lever arm 40 about axis 47 according to some embodiments. In some embodiments, adjustable length internal lever arm 40 and second arm 30 can comprise interlocking connection mechanisms that allow locking and unlocking of adjustable length internal lever 40 arm at different angles about axis 47 with respect to second arm 30. In some embodiments, distal end 33 of second arm 30 can comprise outwardly deflectable teeth 70, and holes 72, as shown in FIG. 19A. In some embodiments, proximal end 41 of inner shaft 50 can comprise outwardly facing teeth 74 and deflectable snaps 76, as shown in FIG. 19B.

In some embodiments, once the preferred angle between second arm 30 and internal lever arm 40 has been set, (i.e.: once the preferred angle about axis 47 and between axes 32 and 43 has been set), teeth 74 of arm 40 can be inserted within outwardly deflectable teeth 70 of second arm 30. In some embodiments, the ends of deflectable snaps 76 can be positioned within holes 72, thus snapping arms 30 and 40 together (thereby holding arms 30 and 40 together at a preferred angle to one another).

Figure 20A:
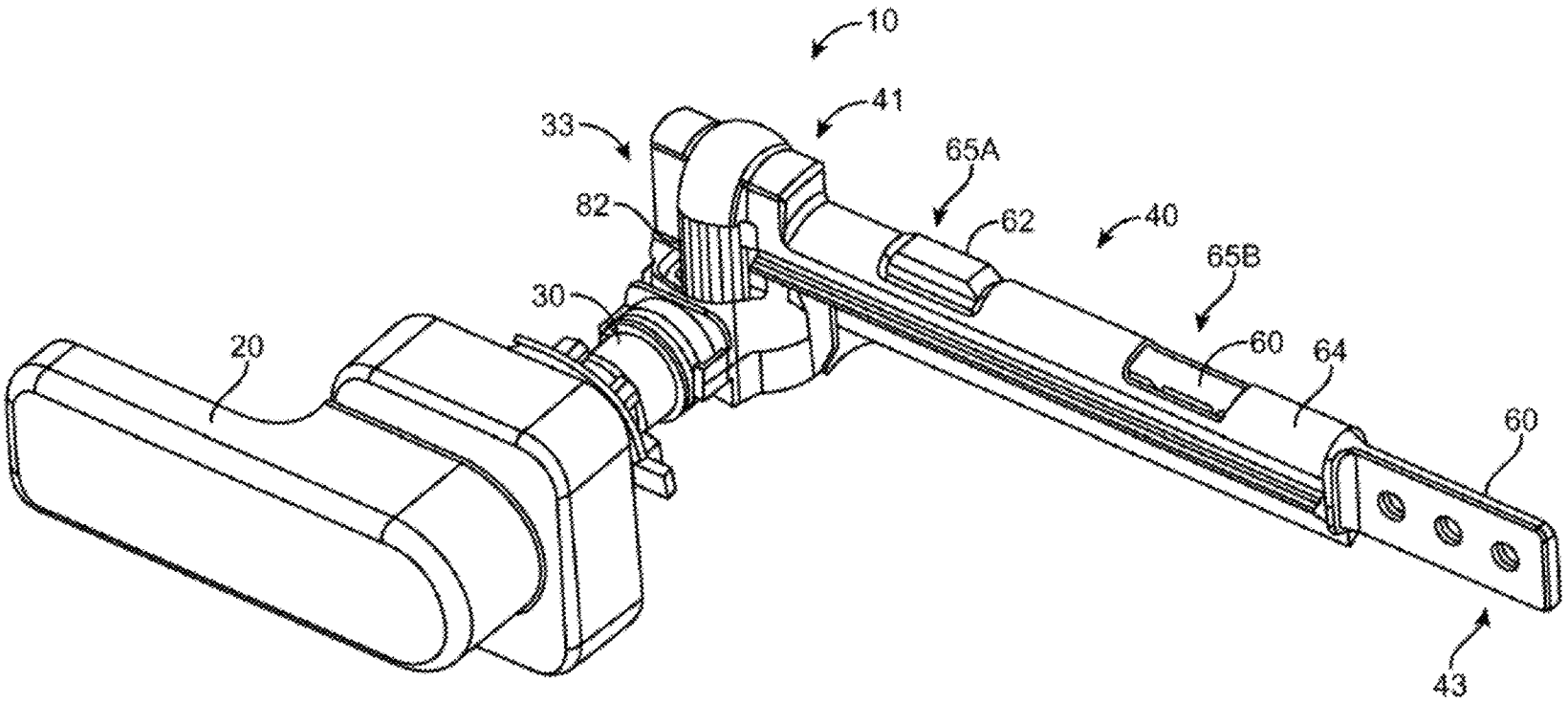
FIG. 20A is a perspective view of a third assembly of the present lever arm assembly according to some embodiments.
Figure 20B:
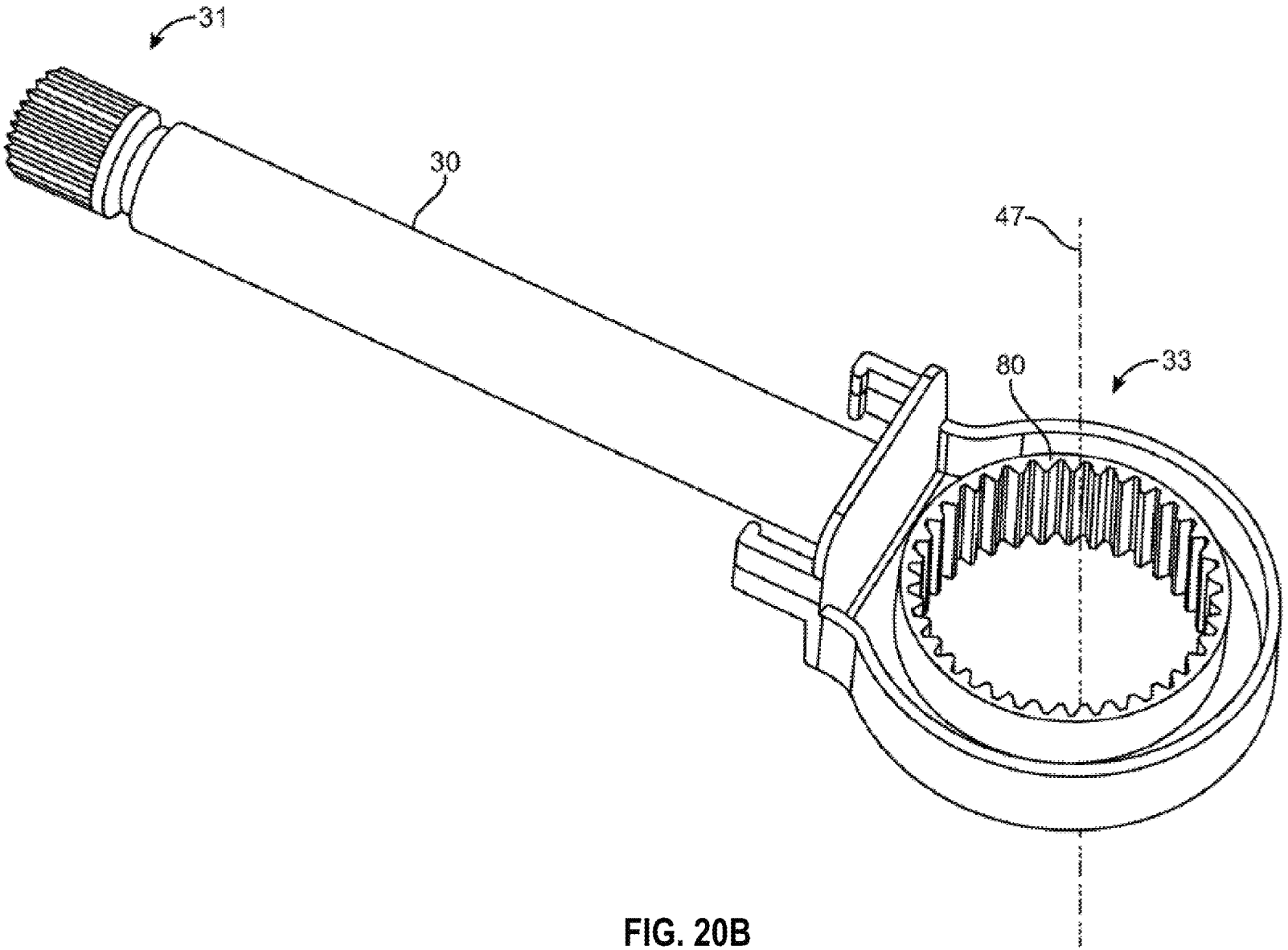
FIG. 20B is a perspective view of the second arm seen in FIG. 20A according to some embodiments.
Figure 20C:
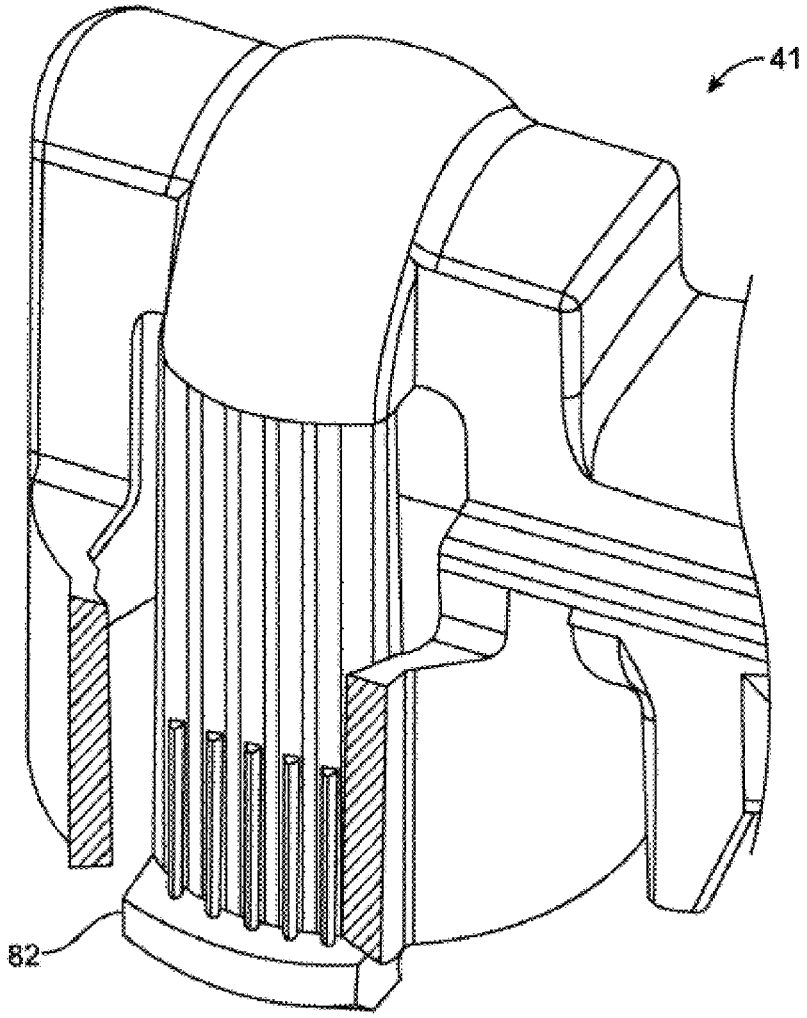
FIG. 20C is a perspective view of the proximal end of the internal lever arm seen in FIG. 20A according to some embodiments.
Figure 20D:
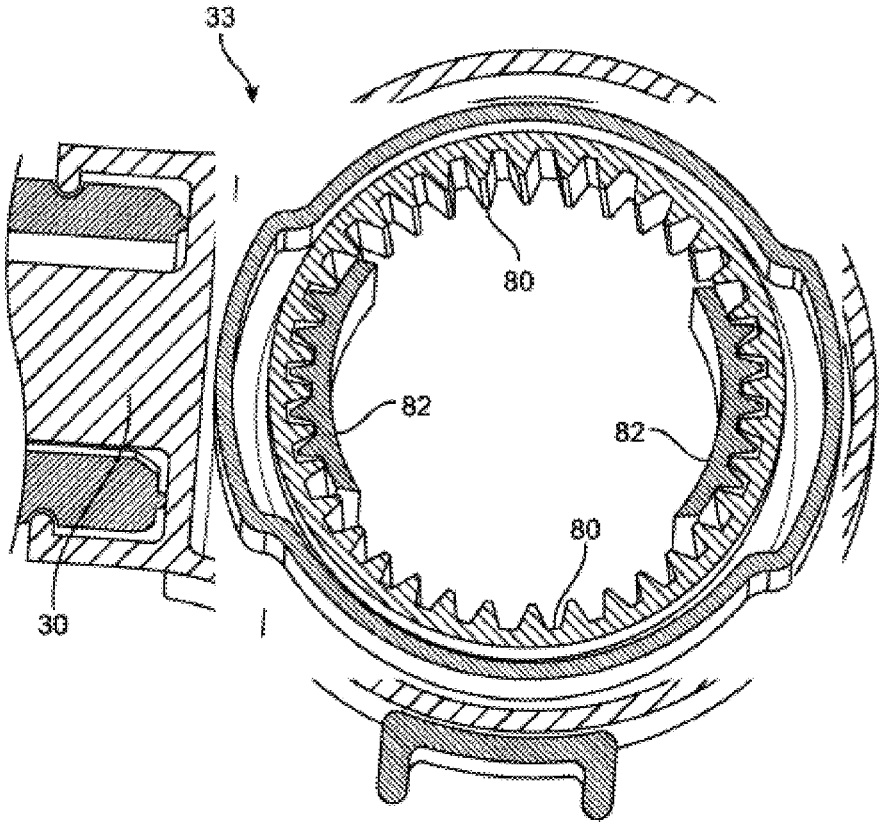
FIG. 20D is a sectional view showing the teeth of the internal lever arm of FIG. 20B interconnecting to the teeth of the second arm of FIG. 20C according to some embodiments.

FIGS. 20A to 20D illustrate another alternative assembly of the connection mechanisms in which distal end 33 of second arm 30 comprise inwardly facing teeth 80 according to some embodiments. In some embodiments, proximal end 41 of internal lever arm 40 can comprise inwardly deflectable teeth 82. In some embodiments, when snapped together, inwardly deflectable teeth 82 can be received within inwardly facing teeth 80 (as shown in FIG. 20D). In some embodiments, an operator can push inwardly deflectable teeth 82 inwardly so that they can move away from inwardly facing teeth 80, as shown in FIG. 20C. In some embodiments, the operator can hold inwardly deflectable teeth 82 inwardly and can rotate adjustable length lever arm 40 to its desired position about axis 47. In some embodiments, when inwardly deflectable teeth 82 are released, they can spring outwardly against inwardly facing teeth 80, locking the position of arm 30 and 40 together.

Figure 21A:
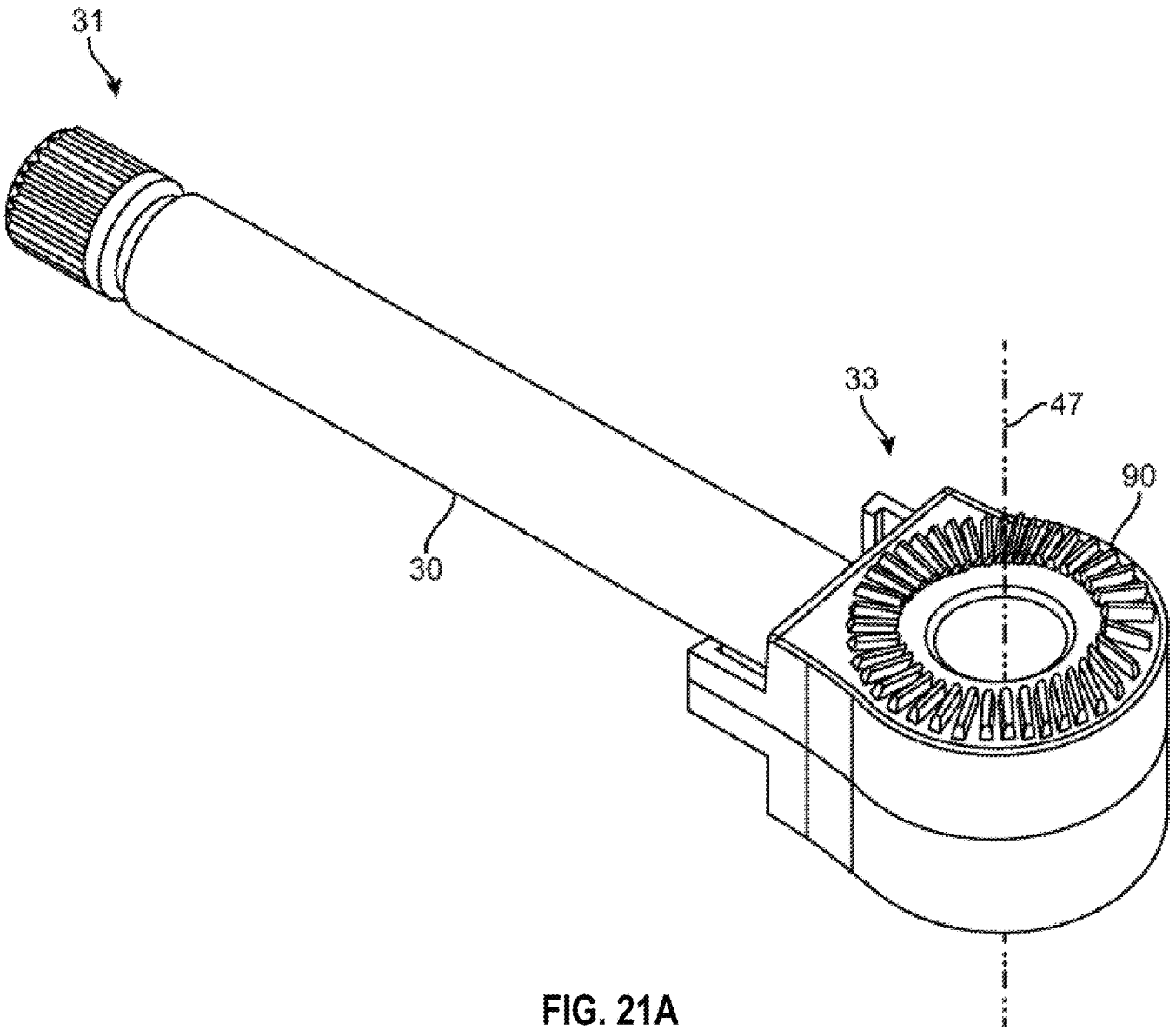
FIG. 21A is a perspective view of another assembly of the second arm according to some embodiments.
Figure 21B:
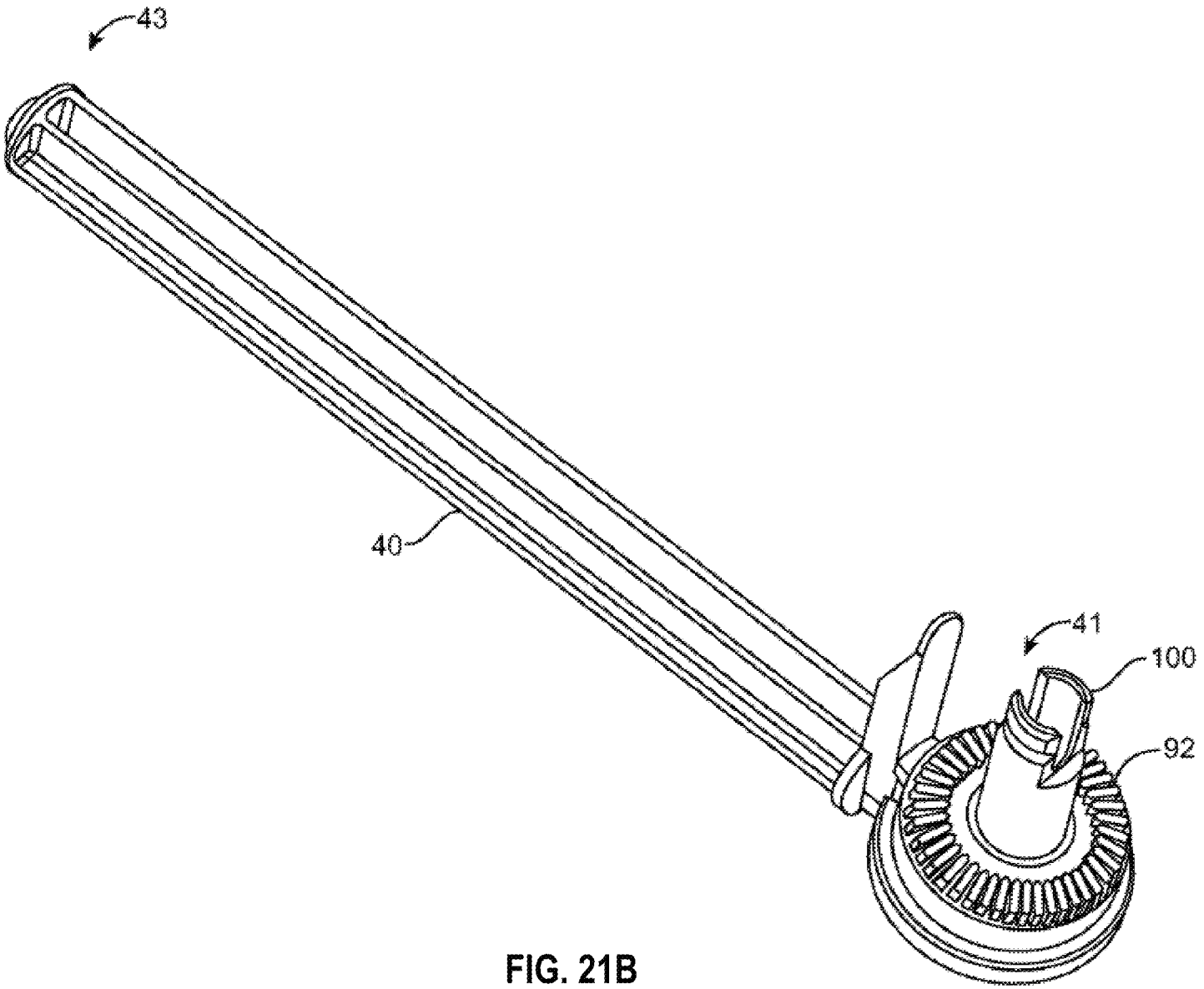
FIG. 21B is a perspective view another assembly of the internal lever arm for use with the second arm of FIG. 21A according to some embodiments.
Figure 21C:
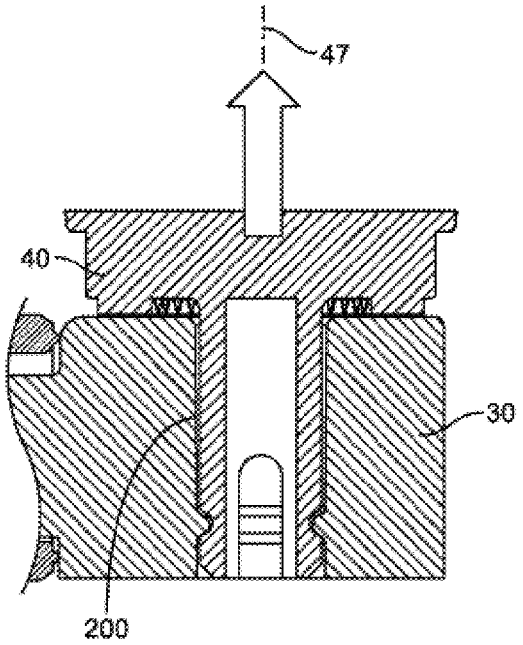
FIG. 21C a sectional elevation view of the lever assembly seen in FIGS. 21A and 21B, showing a connector pin in a lowered, locked position according to some embodiments.
Figure 21D:
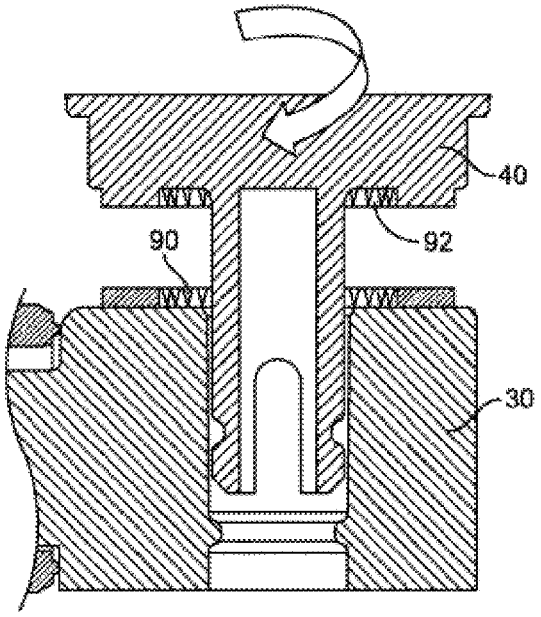
FIG. 21D shows the connector pin of FIG. 21C in a raised unlocked position according to some embodiments.

FIGS. 21A to 21D illustrate another assembly of the connection mechanisms in which distal end 33 of second arm 30 comprises vertically projecting gear teeth 90 according to some embodiments. In some embodiments, proximal end 41 of adjustable length lever arm 40 can comprise vertically projecting gear teeth 92. In some embodiments, vertically projecting gear teeth 90 on second arm 30 can mate with vertically projecting gear teeth 92 on adjustable length internal lever arm 40. In some embodiments, locking plug 200 can be provided for holding second arm 30 and lever arm 40 together, as shown in FIGS. 21C and 21D. In some embodiments, to adjust the angle between arms 30 and 40, locking plug 200 can be unseated (FIG. 21D), and the arms can be rotated to a preferred location. In some embodiments, locking plug 200 can be re-seated (FIG. 21C), such that gears 90 and 92 can mesh together and prevent rotation.

In some embodiments, it is to be understood that the connection mechanisms described on the ends of each of arms 30 and 40 can be reversed, and that the present system can encompass any form of connection mechanisms including, but not limited to, ridges, teeth, gears, or snaps.

Figure 12:
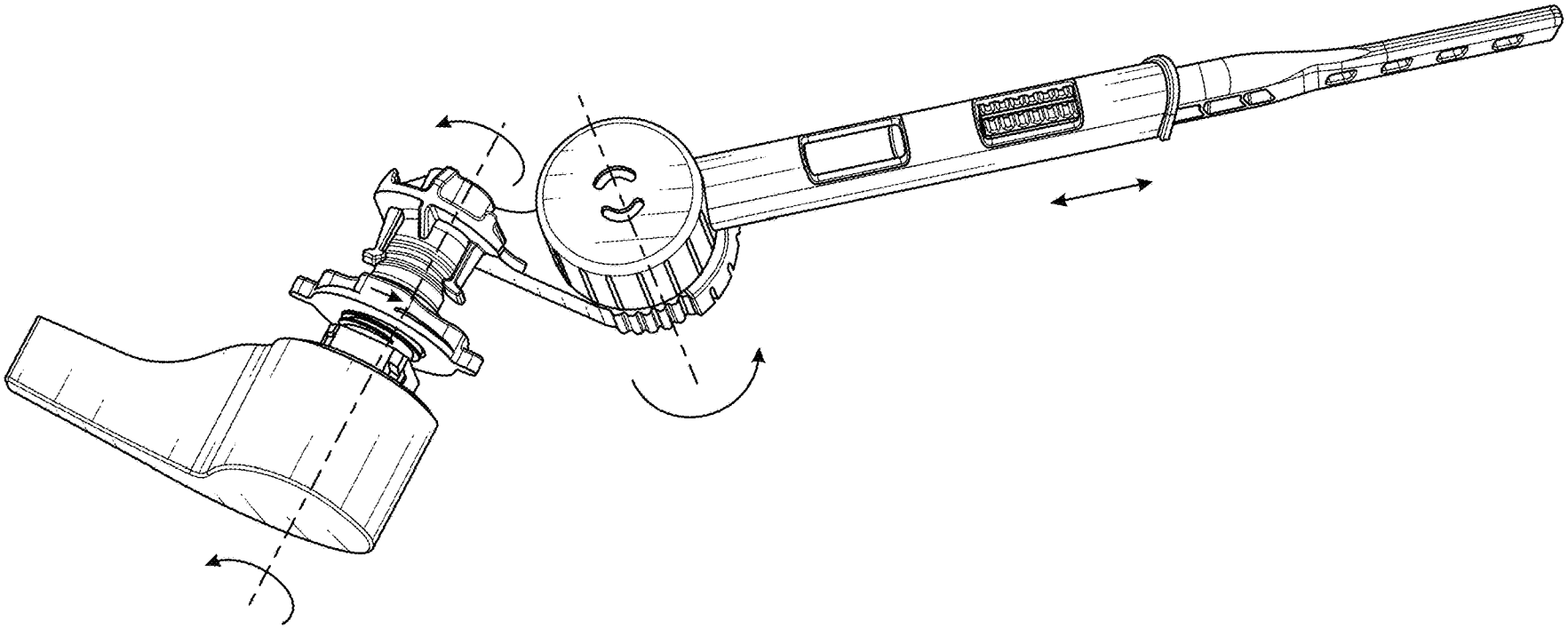
FIG. 12 is a perspective view of another lever assembly according to some embodiments.
Figure 22A:
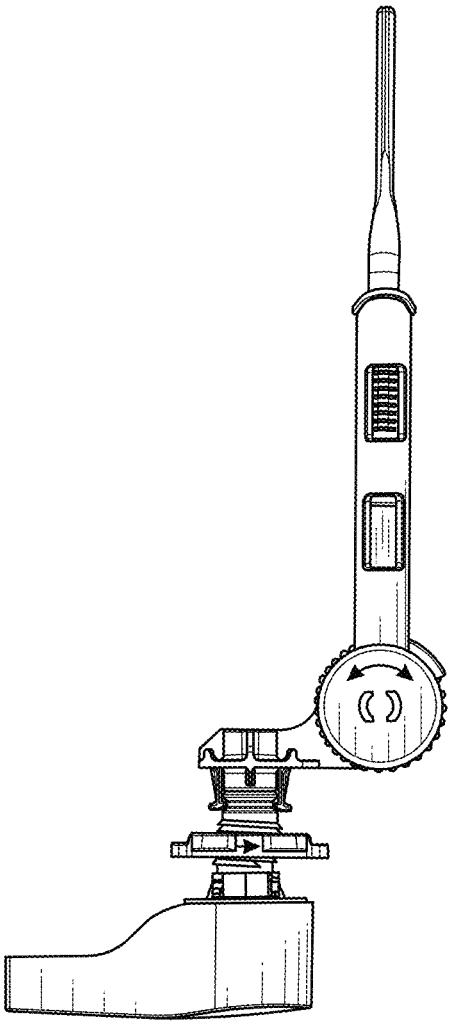
FIG. 22A shows an alternate embodiment of a left-side mount of the lever assembly of FIG. 1 according to some embodiments.
Figure 22B:
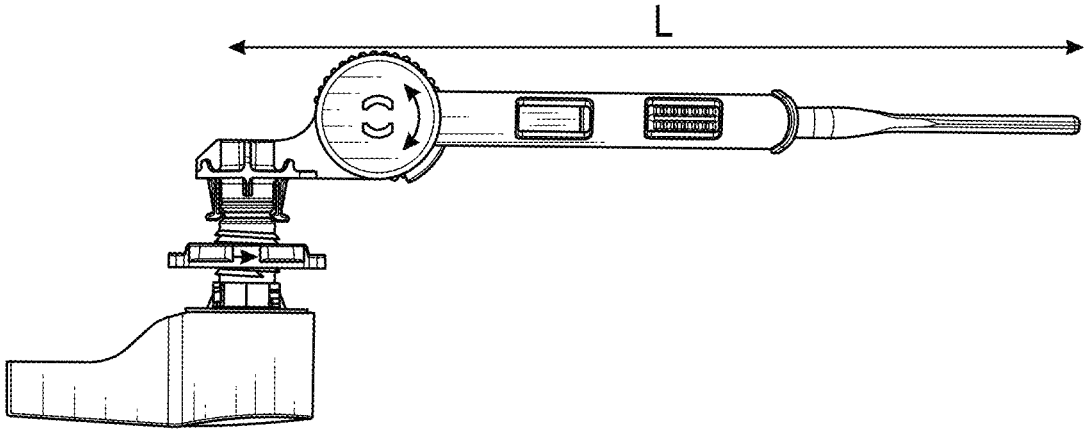
FIG. 22B shows an alternate embodiment of a left-side mount of the lever assembly of FIG. 1 according to some embodiments.
Figure 22C:
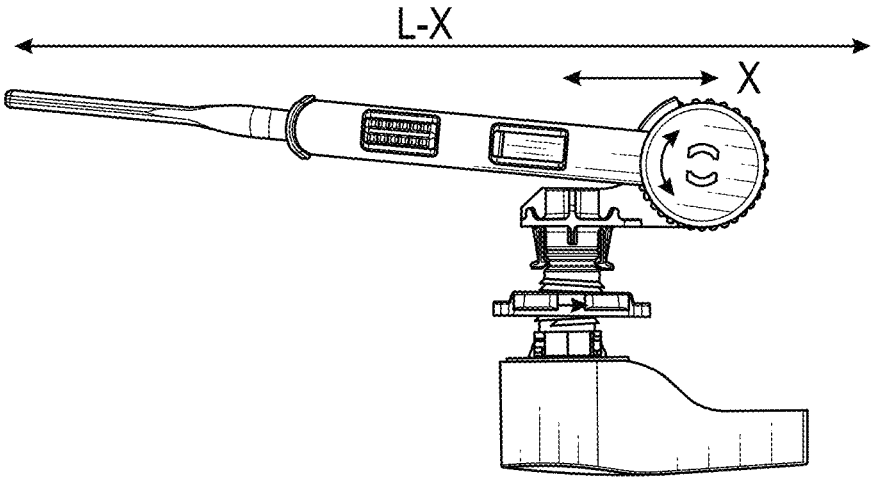
FIG. 22C shows an alternate embodiment of a right-front mount of the lever assembly of FIG. 1 according to some embodiments.
Figure 22D:
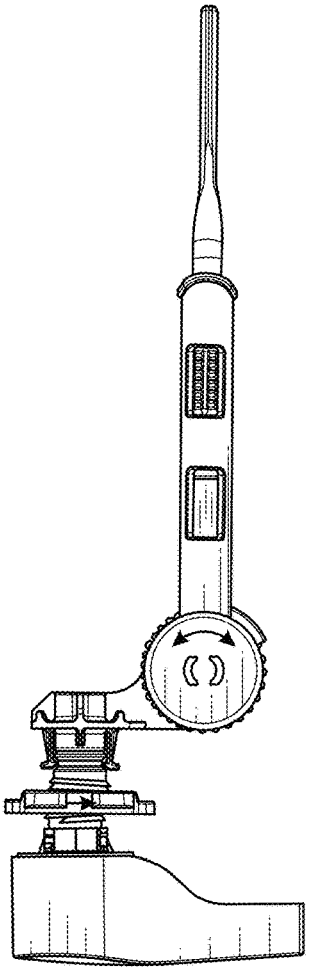
FIG. 22D shows an alternate embodiment of a right-side mount of the lever assembly of FIG. 1 according to some embodiments.
Figure 22E:
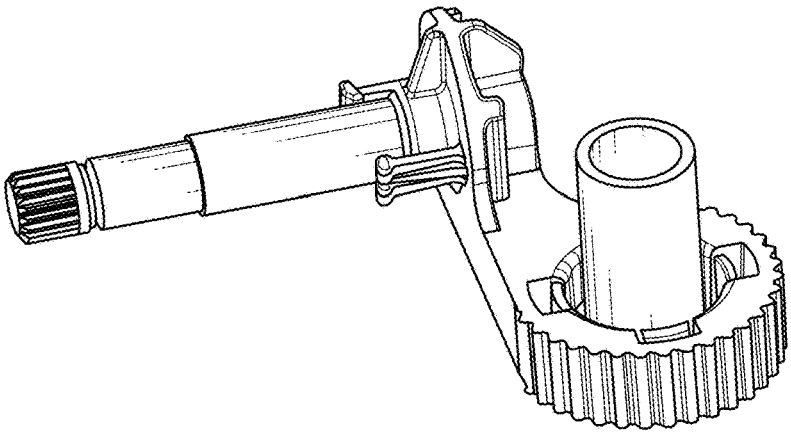
FIG. 22E shows a distal mount of the lever of FIG. 12 according to some embodiments.

In some embodiments, view of the lever assembly of FIG. 12 is shown in FIGS. 22A-22D. For example, FIG. 22A shows a representation of a left-side mount of the lever of FIG. 12, and FIG. 22B shows a representation of a left-front mount of the lever of FIG. 12 according to some embodiments. FIG. 22C shows a representation of a right-front mount of the lever of FIG. 12, and FIG. 22D shows a representation of a right-side mount of the lever of FIG. 12, and FIG. 22E shows a distal mount of the lever of FIG. 12 according to some embodiments.

Figure 23A:
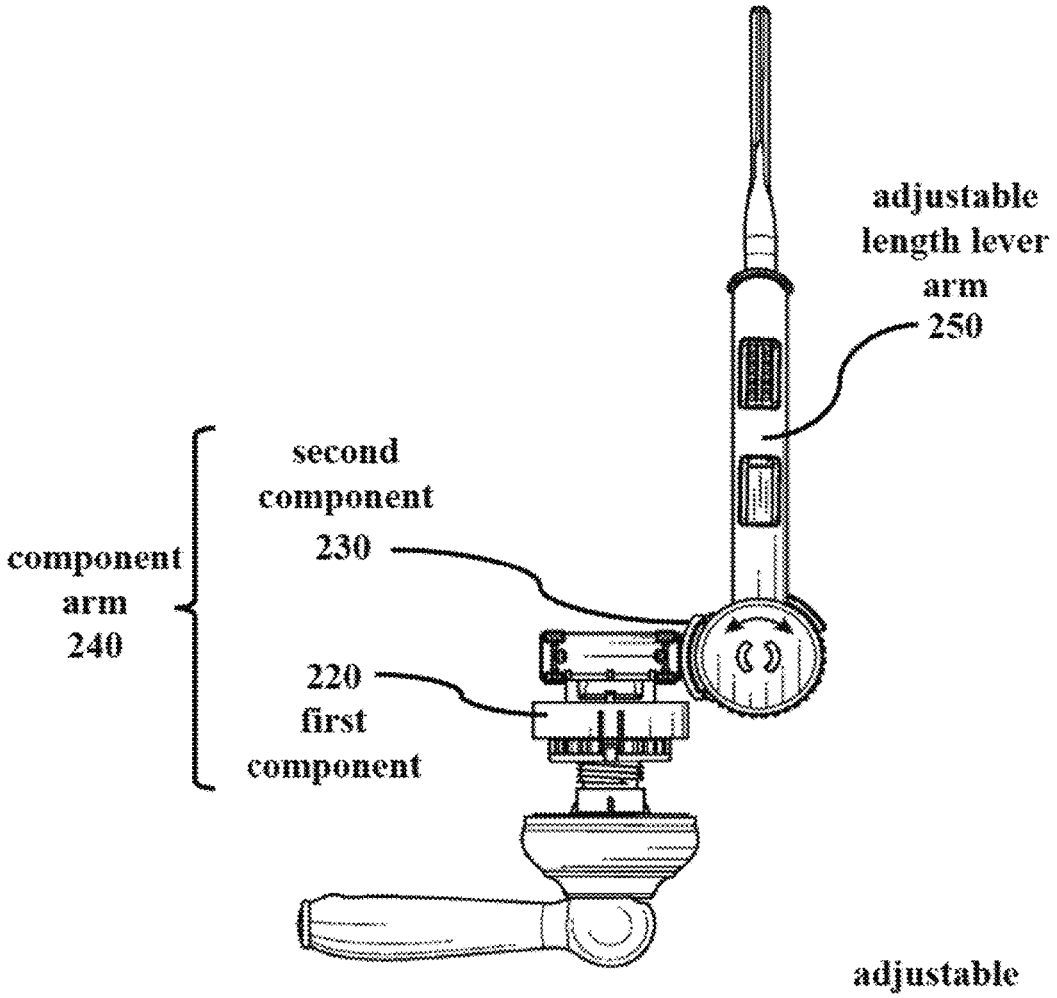
FIG. 23A shows a representation of a left-side mount of the lever arm assembly of FIG. 1 according to some embodiments.
Figure 23B:
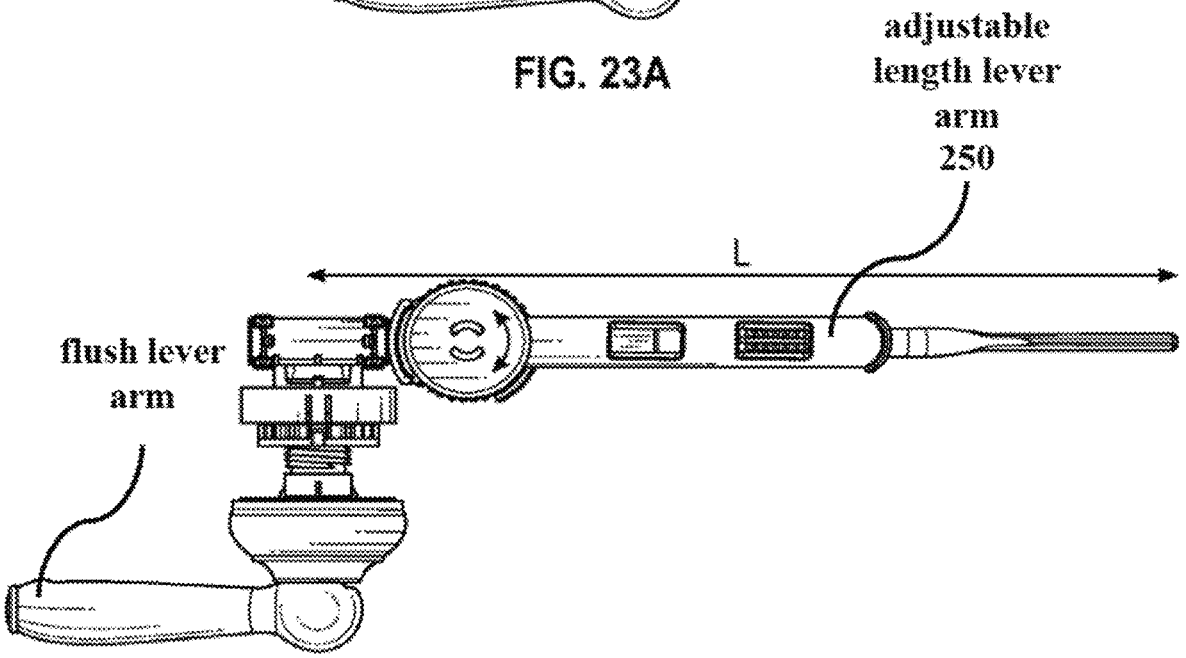
FIG. 23B shows a representation of a left-front mount of the lever arm assembly of FIG. 1 according to some embodiments.
Figure 23C:
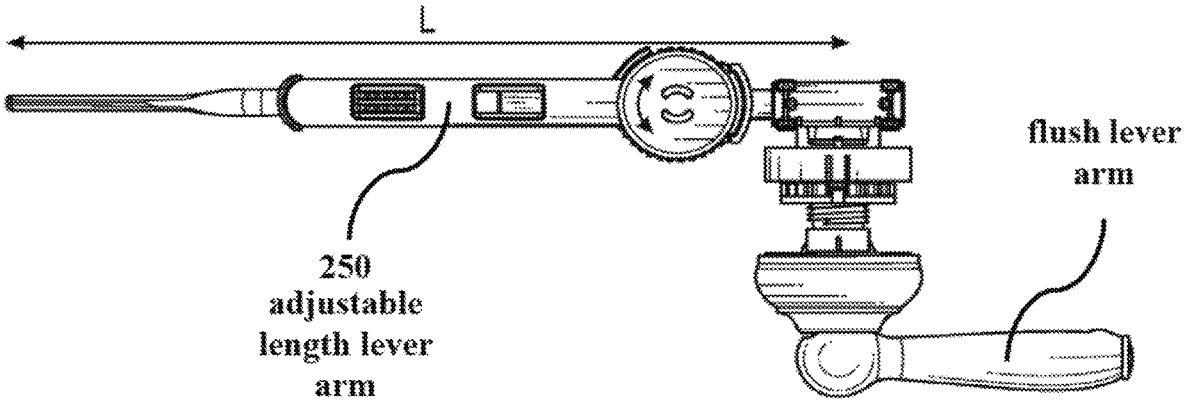
FIG. 23C shows a representation of a right-front mount of the lever arm assembly of FIG. 1 according to some embodiments.
Figure 23D:
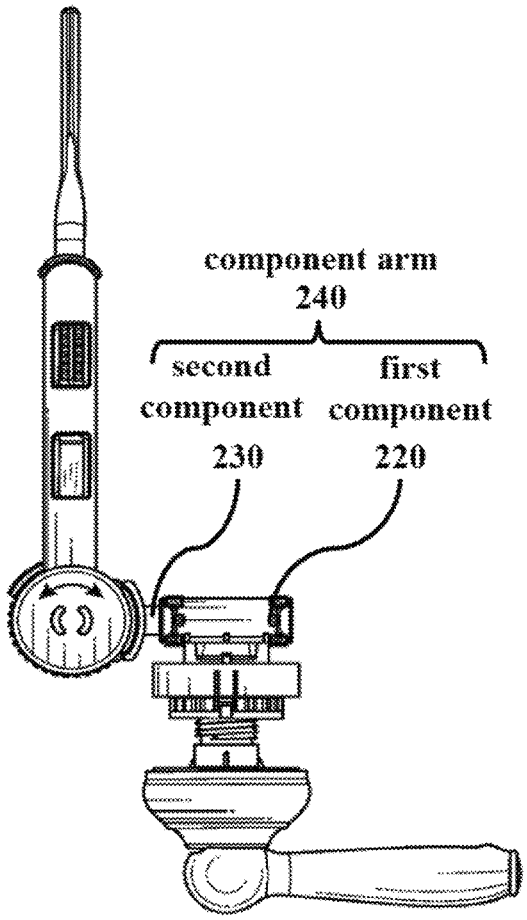
FIG. 23D shows a representation of a right-side mount of the lever arm assembly of FIG. 1 according to some embodiments.
Figure 23E:
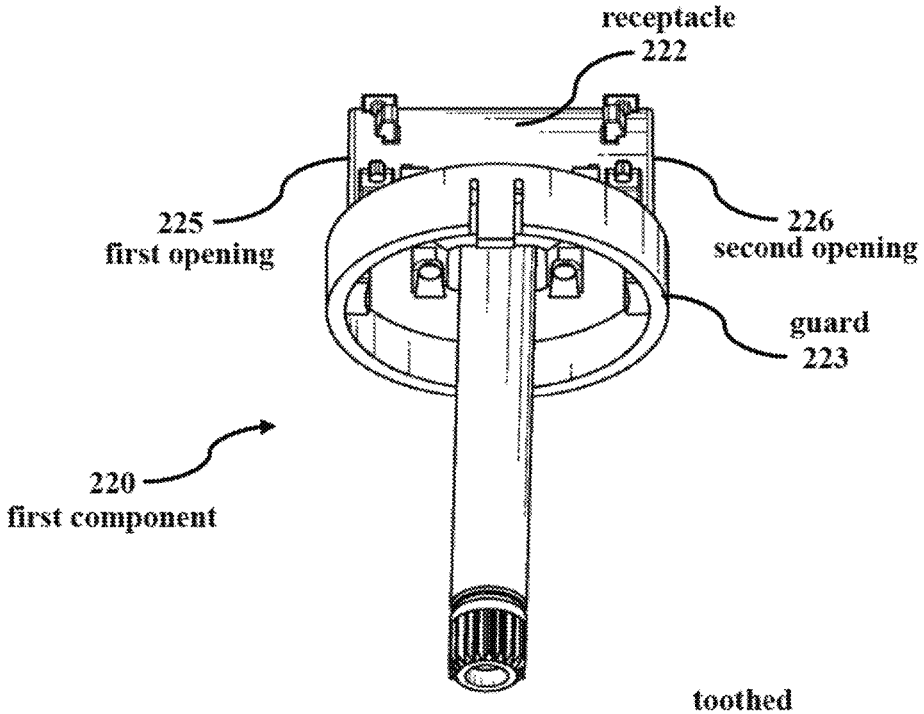
FIG. 23E shows a first component of the lever assembly of FIG. 12 according to some embodiments.
Figure 23F:
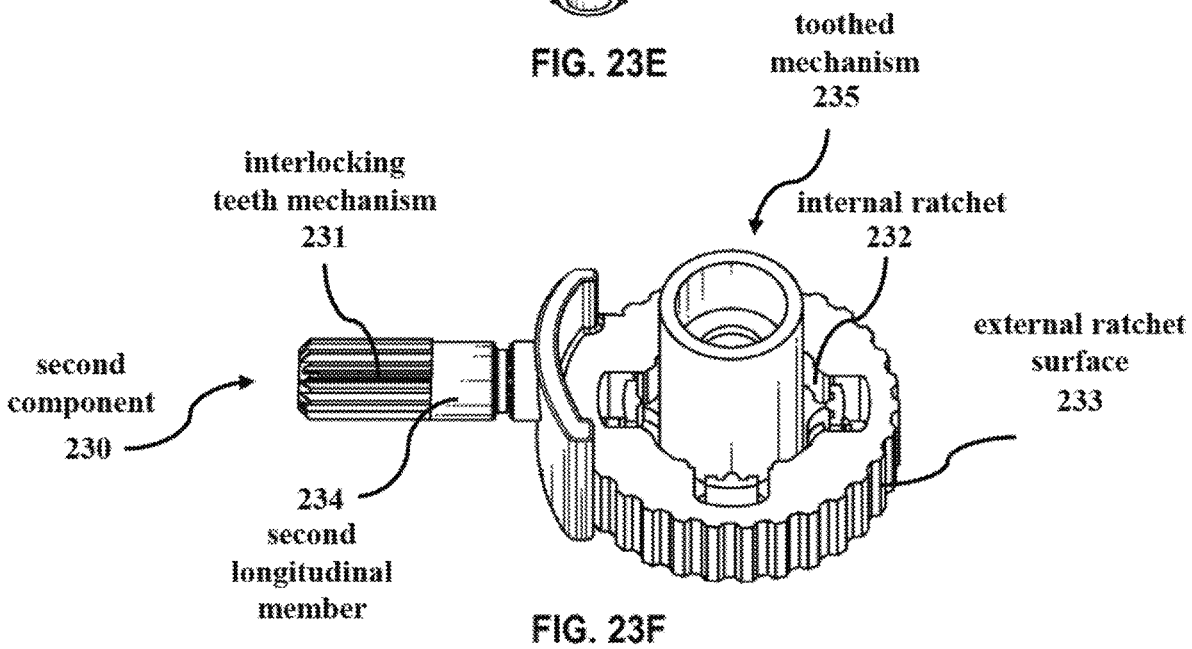
FIG. 23F shows a second component of the lever assembly of FIG. 12 according to some embodiments.

In some embodiments, shown in FIG. 1, and in FIGS. 23A-23F, FIG. 24B, and FIG. 25B, a second arm, also referred to herein as a component arm 240, can be designed as two components such as a first component 220 and a second component 230 (see FIGS. 23E and 23F). In some embodiments, an interlocking teeth mechanism 231 can provide adjustability for the adjustable length lever arm 250. In some embodiments, a second component 230 can be click fitted or otherwise coupled onto first component 220 on both sides via a first opening 229A or a second opening 229B. In some embodiments, lever rotation stroke can be provided on first component 220 which works in clockwise and counter clockwise directions.

In some embodiments, first component 220 and second component 230 can include a toothed mechanism which allows adjustability and another degree of freedom for user. In some embodiments, the second axis 292 of this new degree of freedom can be in a perpendicular direction 224 to the flush lever arm axis 290 of the chassis, link and flush lever arm 210 rotation.

In some embodiments, by flipping first component 220 and handle sub assembly 180 degrees or by attaching second component 230 to the other side of first component 220, the stroke length of the lever can be maintained.

In some embodiments, first component 220 and second component 230 can be assembled with teeth gear engagement and snap click fit. In some embodiments, after disengaging snap click and teeth gear, first component 220 and second component 230 can rotate 360 degrees.

In some embodiments, first component 220 can be considered a first component of the second arm and second component 230 can be considered a second component of the second arm. In some embodiments, the first component 220, as depicted in FIG. 23E can include a first longitudinal member 221 as shown in the vertical direction towards the bottom of FIG. 23E. In some embodiments, the first longitudinal member 221 can be a post. In some embodiments, this first longitudinal member 221 can be configured to engage the external flush lever arm 210, as shown in FIG. 13A, item 20. In some embodiments, the first longitudinal member 221 can engage the external flush lever arm 210 at a one end. In some embodiments, at the opposite end of the first longitudinal member 221, a receptacle 222 can be positioned. In some embodiments, the receptacle 222 can be substantially cylindrical. In some embodiments, the receptacle 222 can extend in a perpendicular direction with respect to the first longitudinal member 221. In some embodiments, the receptacle 222 and the first longitudinal member 221 can be separated by a guard 223. For example, as shown in FIG. 23E, the guard 223 can be circular.

In some embodiments, the second component 230, as shown in FIG. 23F, can comprise a second longitudinal member 234 comprising an interlocking teeth mechanism 231 shown in FIG. 23F extending horizontally. In some embodiments, the second longitudinal member 234 can be a post. In some embodiments, the second longitudinal member 234 of FIG. 23F can be inserted into or otherwise coupled with the receptacle 222 of the first component 220. In some embodiments, the first component 220 and second component 230 can be coupled in a perpendicular manner as defined by their respective longitudinal members. In some embodiments, the coupling between the first component 220 and second component 230 can be referred to as an interface. In some embodiments, the interface can comprise a slot and key. In some embodiments, the interface can also comprise a gear assembly and snap click fit to couple together the first component 220 and second component 230.

Similar to FIGS. 16A and 16B, as depicted in FIG. 23F, in some embodiments, second component 230 can have an internal ratchet 232 and an external ratchet surface 233. In some embodiments, hollow outer slider 251 can have an internal ratchet surface 252 and an external ratchet arm 253. In some embodiments, elements 253 and 233 can mate together and elements 232 and 252 can mate together.

In some embodiments, adjustable length lever arm 250 can be rotatable about first axis 291 to a first angle. In some embodiments, when the first component 220 and second component 230 are coupled together, the second component 230 can rotate axially about a second axis 262 defined by a first opening 225 and a second opening 226 of the receptacle 222 of the first longitudinal member 221 to a second angle. In some embodiments, the second axis 262 extends in a perpendicular direction 224 to a flush lever arm axis 260 defined by the first longitudinal member 221. In some embodiments, the flush lever arm axis 260 extends between a first member first end 227 and a first member second end 228 of the first longitudinal member 221. In some embodiments, the receptacle 222 of the first component 220 is positioned at the first member second end 228 of the first longitudinal member 221 of the first component 220. In some embodiments, this rotation can be limited to 180 degree adjustments so that the second component 230 essentially mirrors its orientation around the first component 220. In some embodiments, this functionality can allow the external flush lever arm 210 to transition from a right-side flusher to a left-side flusher and back again.

In some embodiments, the second component 230 can include a circular toothed mechanism 235 positioned away from the second longitudinal member 230, the toothed mechanism 235 can be used to couple the adjustable length lever arm 250 to the second component 230 so that the adjustable length lever arm 250 can be configured to rotate about a first axis 291 defined by the toothed mechanism 235.

Some embodiments can provide a lever stroke in both clockwise and counter clockwise directions. In some embodiments, the rotational stroke can have spring action and a stopper on first component 220 which can provide a stroke stop or travel limit.

Figure 24A:
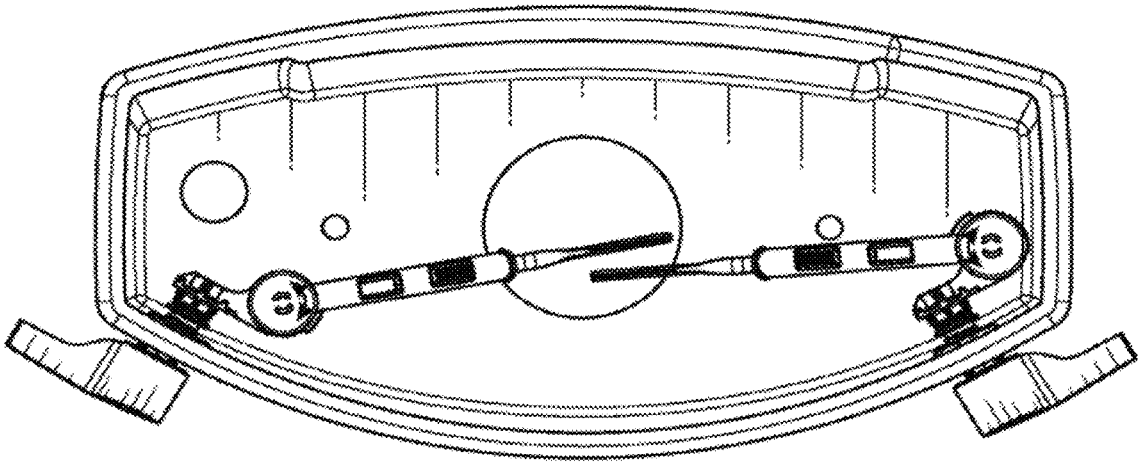
FIG. 24A shows installed lever assembly of FIG. 12 installed on a left side and right side of a tank according to some embodiments.
Figure 24B:
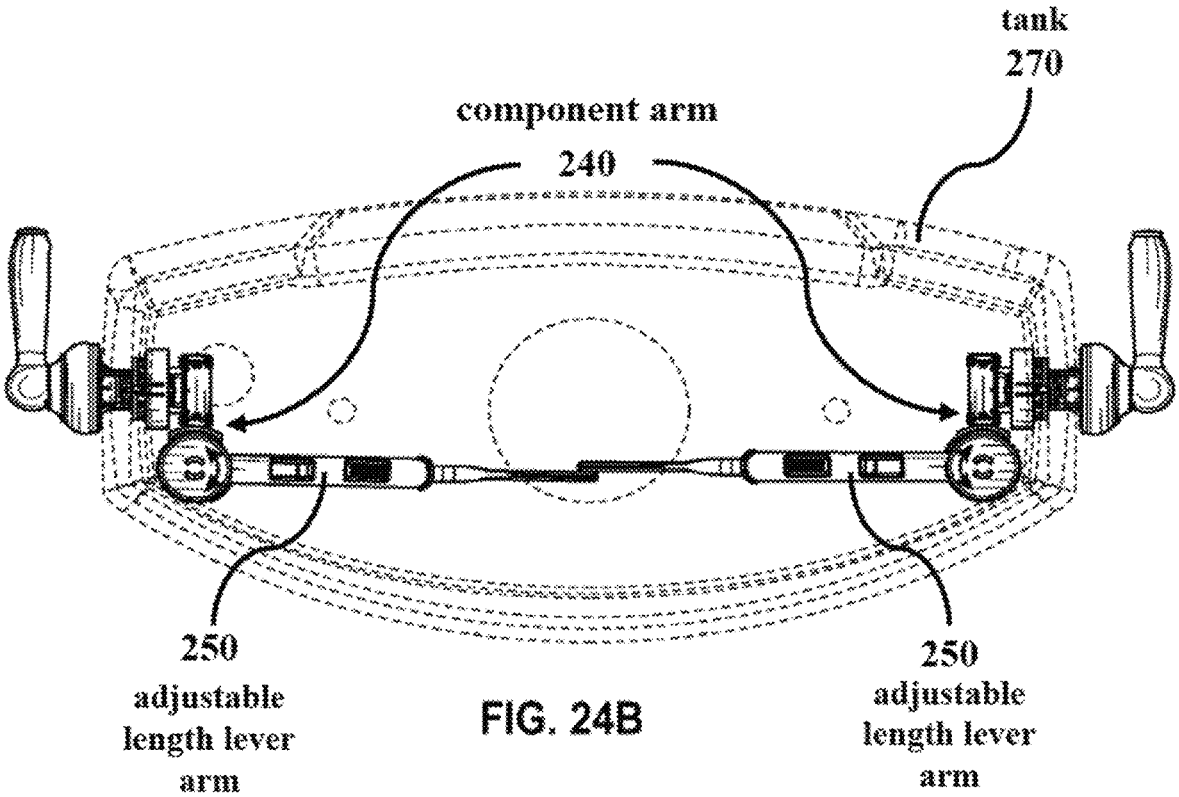
FIG. 24B shows installed lever arm assembly of FIG. 1 installed on a left side and right side of a tank according to some embodiments.
Figure 25A:
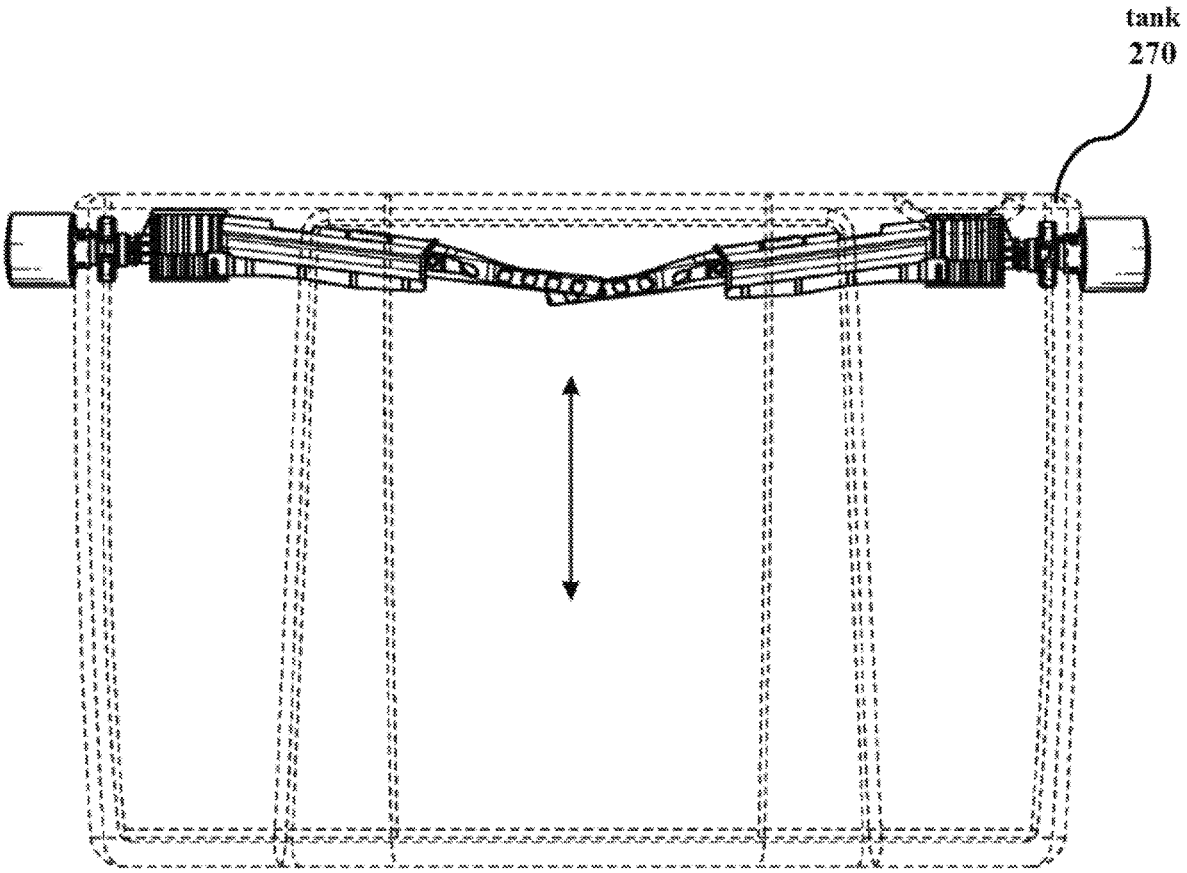
FIG. 25A shows a front view of a tank with the installed lever assemblies of FIG. 24A according to some embodiments.
Figure 25B:
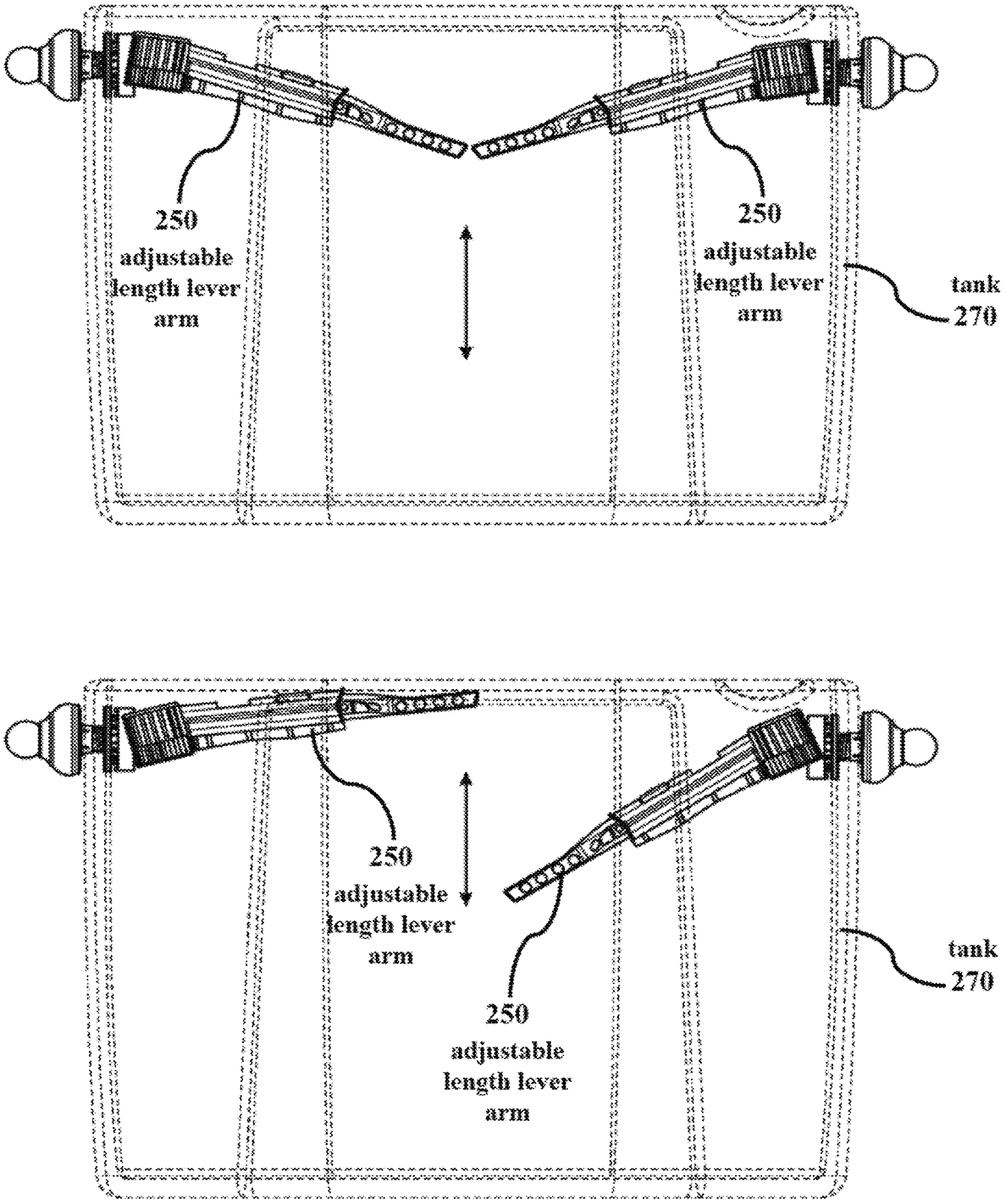
FIG. 25B shows front views of tanks with the installed lever arm assemblies of FIG. 24A according to some embodiments.

Some embodiments function with a wide range of toilet tanks height and shape. For example, FIG. 24A displays installed lever assembly of FIG. 12 installed on a left side and right side of a tank, and can be compared with FIG. 24B, showing installed lever arm assembly 200 of FIG. 1 installed on a left side and right side of a tank 270 according to some embodiments. FIG. 25A displays a front view of a tank with the installed lever assemblies of FIG. 24A, and FIG. 25B shows front views of tanks 270 with the installed lever arm assemblies 200 of FIG. 24B according to some embodiments. FIGS. 24A and 25A illustrate one or more short comings of the structure of FIG. 12 while FIG. 24B and FIG. 25B illustrate improved structures of lever arm assembly 200 according to some embodiments.

In some embodiments, an interface between first component 220 and second component 230 can have pre-defined adjustments. For example, an interface can be a slot and key which allows only 180 degree adjustment.

In some embodiments, a snap click fit between first component 220 and second component 230 can have plastic snap locking clip for locking the adjustment instead of metal "C" shaped pins. In some embodiments, the lever assembly can comprise a provision to function with lever assemblies of FIGS. 2-11 and/or the lever assemblies of FIGS. 13A-21D which are described in detail in support of the embodiment of FIG. 1.

Figure 26:
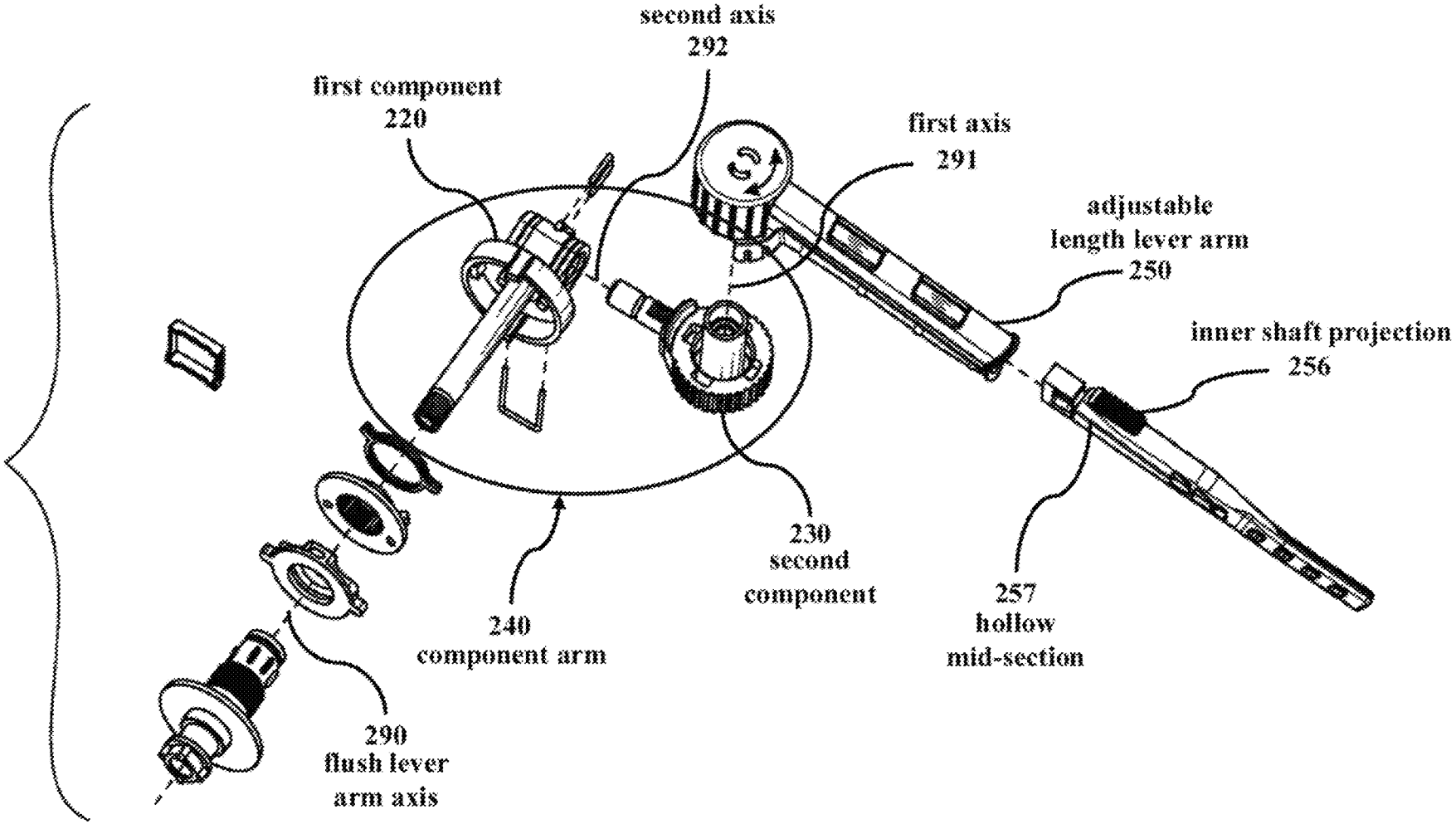
FIG. 26 shows the various components that may be used to construct a lever arm assembly according to some embodiments.

FIG. 26 shows the various components that can be used to construct a lever arm assembly 200 according to some embodiments. The lever arm assembly 200 can be attached to a flush lever arm 210. The flush lever arm 210 can be attached at a mount chassis. The mount chassis is inserted into to a nut, which couples to a cover and a spring in a similar manner as described in relation to FIGS. 2-11.

FIG. 26 shows an arm made up of a first component 220 and second component 230. The first component 220 may be referred to as the "second arm" described in FIG. 23E. The first component 220 may also be referred to as a "short arm" as referenced in FIG. 26. The mount chassis is configured to engage a first longitudinal member 221 of the first component 220 as shown in FIG. 26.

FIG. 26 additionally shows the second component, which may be referred to as the "second arm" described in FIG. 23F. The second component may also be referred to as a "short arm ratchet" as referenced in FIG. 26. The second component 230 includes a longitudinal member that engages the first component 220 at a perpendicular angle.

Also shown in FIG. 26 is the adjustable length lever arm 250 that couples to the second component 230. The adjustable length lever arm 250 can comprise a hollow outer slider 251 and an inner shaft 252 that slides into the hollow outer slider 251 in accordance with some embodiments.

In some embodiments, the adjustable length lever arm 250 can comprise an inner shaft 252, a hollow outer slider 251 received onto inner shaft 50, and inner shaft projection 256 to fix the inner shaft 252 at a desired position along within the length of the hollow outer slider 251, similar to as shown in FIGS. 13A through 15B. In some embodiments, inner shaft 252 can have a inner shaft projection 256 thereon. In some embodiments, inner shaft 252 can have a hollow mid-section 257 (FIG. 26) adjacent to the inner shaft projection 256 to permit the inner shaft projection 256 to flex inwardly when depressed. In some embodiments, inner shaft projection 256 on inner shaft 252 can protrude through one of apertures 258 to fix the hollow outer slider 251 at a desired position along the length of inner shaft 252.

FIG. 27A shows a first view of a first component 220 of the lever arm assembly 200 according to some embodiments. Specifically, FIG. 27A shows the first component 220 depicted in FIG. 26 having a first longitudinal member 221 pointing downwards and a cylindrically shaped receptacle 222 positioned at a first member second end 228 of the first longitudinal member 221.

FIG. 27B shows a second view of a first component 220 of the lever arm assembly 200 according to some embodiments. Specifically, FIG. 27B shows the first component 220 with the first longitudinal member 221 pointing upwards and a cylindrically shaped receptacle 222 positioned at a first member second end 228 of the first longitudinal member 221. The view in FIG. 27B shows the cylindrically shaped receptacle 222 positioned underneath the first longitudinal member 221.

FIG. 28 shows a view of a second component 230 of the lever arm assembly 200 according to some embodiments. Specifically, FIG. 28 shows the second component 230 depicted in FIG. 26 with a second longitudinal member 234 pointing towards the left. The second component 230 includes a cylindrically shaped toothed mechanism 235 positioned at a perpendicular angle with respect to the second longitudinal member 234 of the second component 230. The cylindrically shaped toothed mechanism 235 of the second component 230 is configured to engage the internal ratchet surface 252 and the external ratchet arm 253 of the hollow outer slider 251 described in FIGS. 29A and 29B.

FIG. 29A shows a first view of the adjustable length lever arm 250 of the lever assembly according to some embodiments. Specifically, FIG. 29A shows a hollow outer slider 25 of the adjustable length lever arm 250. The hollow outer slider 251 includes a protrusion 254 that engages the cylindrically shaped toothed mechanism 235 of the second component 230. FIG. 29A shows the protrusion 254 exposed towards the left-hand side of FIG. 29A. In some embodiments, this protrusion is protected, in part, by a cap 255.

FIG. 29B shows a first view of the adjustable length lever arm 250 of the lever arm assembly 200 according to some embodiments. Specifically, FIG. 29B shows the hollow outer slider 251 of the adjustable length lever arm 250 in an inverted view compared to FIG. 29A. The view in FIG. 29B shows the protrusion 254 being hidden underneath the cap 255.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the description and figures.

Therefore, the following is claimed:

1. A toilet flush lever arm assembly comprising:
a flush lever arm,
a component arm, and
an adjustable length lever arm;
wherein the flush lever arm is configured to couple to the component arm;
wherein the component arm is configured to couple to the adjustable length lever arm;
wherein rotation of the flush lever arm about a flush lever arm axis is configured to raise or lower the adjustable length lever arm via the component arm;
wherein the component arm is configured to enable the adjustable length lever arm to be rotated about a first axis to a first angle;
wherein at least a portion of the component arm is configured to be rotated about a second axis to a second angle;
wherein a rotation of the flush lever arm is configured to rotate the second axis about the flush lever arm axis;
wherein the component arm is separable into a first component and a second component;
wherein the first component and the second component are configured to be coupled with an interlocking teeth mechanism along the second axis;
wherein the adjustable length lever arm comprises:
an inner shaft, and
a hollow outer slider;
wherein the hollow outer slider is configured to receive the inner shaft;
wherein a length of the adjustable length lever arm is configured to be adjusted by moving the inner shaft back and forth within the hollow outer slider;
wherein the second component comprises:
an internal ratchet, and
an external ratchet surface; and
wherein the hollow outer slider comprises:
an internal ratchet surface, and
an external ratchet arm.

2. The toilet flush lever arm assembly of claim 1,
wherein the hollow outer slider is configured to mate with the second component.

3. The toilet flush lever arm assembly of claim 1,
wherein the external ratchet surface is configured to mate with the external ratchet arm; and
wherein the internal ratchet is configured to mate with the internal ratchet surface.

4. The toilet flush lever arm assembly of claim 1,
wherein the interlocking teeth mechanism is configured to enable the component arm to be adjustable.

5. The toilet flush lever arm assembly of claim 4,
wherein the first component includes a first longitudinal member and a receptacle;
wherein the receptacle comprises a first opening and a second opening; and
wherein the receptacle is configured to enable the second component to be coupled to either the first opening or the second opening.

6. The toilet flush lever arm assembly of claim 1,
wherein the inner shaft further comprises:
an inner shaft projection, and
a hollow mid-section;
wherein the inner shaft projection is configured to lock the inner shaft at a desired position along the length of the hollow outer slider; and
wherein the hollow mid-section is configured to enable the inner shaft projection to flex inwardly when depressed.

7. The toilet flush lever arm assembly of claim 6,
wherein the hollow outer slider comprises one or more apertures; and
wherein the one or more apertures are configured to enable the inner shaft projection to protrude through.

8. The toilet flush lever arm assembly of claim 7,
wherein the adjustable length lever arm is configured to be at a maximum length when the inner shaft projection protrudes through one of the one or more apertures; and
wherein the adjustable length lever arm is configured to be at a minimum length when the inner shaft projection protrudes through another of the one or more apertures.

9. The toilet flush lever arm assembly of claim 8,
wherein the one or more apertures are more than two apertures; and
wherein the more than two apertures are configured to provide intermediate lengths for the adjustable length lever arm.

10. A toilet flush lever arm assembly comprising:
a flush lever arm,
a component arm, and
an adjustable length lever arm;
wherein the flush lever arm is configured to couple to the component arm;
wherein the component arm is configured to couple to the adjustable length lever arm;
wherein a rotation of the flush lever arm about a flush lever arm axis is configured to raise or lower the adjustable length lever arm via the component arm;
wherein the component arm comprises a first component and a second component;
wherein the first component is configured to couple to the flush lever arm;
wherein the second component is configured to couple to the adjustable length lever arm;
wherein the second component is configured to enable the adjustable length lever arm to be rotated about a first axis;
wherein the first component and the second component are configured to be rotatable relative to each other about a second axis;
wherein rotating the second component relative to the first component is configured to change an angle of the adjustable length lever arm;

wherein the first axis is different than the second axis;

wherein the second axis is different from the flush lever arm axis;

wherein the flush lever arm axis is different from the first axis;

wherein the first component includes a first longitudinal member and a receptacle;

wherein the first longitudinal member comprises a first member first end configured to engage the flush lever arm;

wherein the receptacle is positioned at a first member second end of the first longitudinal member;

wherein the receptacle extends in a perpendicular direction with respect to the first longitudinal member along the second axis; and wherein the second component is configured to couple to the receptacle.

11. The toilet flush lever arm assembly of claim 10, wherein the adjustable length lever arm comprises:

an inner shaft, and a hollow outer slider;

wherein the hollow outer slider is configured to receive the inner shaft; and wherein a length of the adjustable length lever arm is configured to be adjusted by moving the inner shaft back and forth within the hollow outer slider.

12. The toilet flush lever arm assembly of claim 11, wherein the hollow outer slider comprises one or more apertures; and wherein the one or more apertures are configured to enable an inner shaft projection to protrude through one of the one or more apertures.

13. The toilet flush lever arm assembly of claim 12, wherein the adjustable length lever arm is configured to be at a maximum length when the inner shaft projection protrudes through one of the one or more apertures.

14. The toilet flush lever arm assembly of claim 13, wherein the adjustable length lever arm is configured to be at a minimum length when the inner shaft projection protrudes through another of the one or more apertures.

* * * * *